US009393777B2

(12) United States Patent
Ohnishi

(10) Patent No.: US 9,393,777 B2
(45) Date of Patent: Jul. 19, 2016

(54) IMAGING DEVICE AND IMAGING METHOD

(75) Inventor: Masaru Ohnishi, Tomi (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 309 days.

(21) Appl. No.: 13/583,996

(22) PCT Filed: Mar. 8, 2011

(86) PCT No.: PCT/JP2011/055333

§ 371 (c)(1),
(2), (4) Date: Dec. 20, 2012

(87) PCT Pub. No.: WO2011/111689

PCT Pub. Date: Sep. 15, 2011

(65) Prior Publication Data

US 2013/0100216 A1 Apr. 25, 2013

(30) Foreign Application Priority Data

Mar. 12, 2010 (JP) ..... 2010-056275

(51) Int. Cl.

| | |
|---|---|
| ***B41J 2/01*** | (2006.01) |
| ***B41J 2/005*** | (2006.01) |
| ***B41J 11/00*** | (2006.01) |
| ***B41M 5/025*** | (2006.01) |

(52) U.S. Cl.

CPC ..... *B41J 2/0057* (2013.01); *B41J 11/002* (2013.01); *B41M 5/0256* (2013.01)

(58) Field of Classification Search

USPC ..... 347/102, 103, 101, 2; 101/35, 36, 37, 101/38.1, 39, 40, 40.1, 41, 42, 43, 44

See application file for complete search history.

(56) References Cited

U.S. PATENT DOCUMENTS

| | | | | |
|---|---|---|---|---|
| 2,539,303 | A * | 1/1951 | Gerke et al. | 101/32 |
| 3,580,772 | A * | 5/1971 | Ochoa | 156/240 |
| 4,836,102 | A * | 6/1989 | Cicci | 101/41 |
| 5,110,599 | A * | 5/1992 | Anhauser et al. | 424/449 |

(Continued)

FOREIGN PATENT DOCUMENTS

| | | |
|---|---|---|
| CN | 1117925 A | 3/1995 |
| CN | 1310101 A | 8/2001 |

(Continued)

OTHER PUBLICATIONS

International Search Report, issued from the Japanese Patent Office, mailed May 24, 2011, 2 pages.

(Continued)

*Primary Examiner* — Juanita D Jackson

(74) *Attorney, Agent, or Firm* — Finnegan, Henderson, Farabow, Garrett & Dunner LLP

(57) ABSTRACT

An image forming device includes an ink-jet head; a procuring ultraviolet irradiation device; a head unit in which is installed the ink-jet head and the procuring ultraviolet irradiation device; a medium holding unit that holds a medium; a transfer sheet unit holding unit that holds a transfer sheet unit, in which a transfer sheet is mounted to a transfer sheet holder; an elastic pad unit; a final curing ultraviolet irradiation device; a cleaning unit; and a control unit. The ink-jet head applies ink to the transfer sheet and the pad unit pushes the transfer sheet against the medium, thus providing a pressure transfer of the ink applied to the transfer sheet to the medium.

23 Claims, 24 Drawing Sheets

(56) References Cited

U.S. PATENT DOCUMENTS

| | | | | |
|---|---|---|---|---|
| 5,488,907 | A * | 2/1996 | Xu et al. | 101/488 |
| 6,045,646 | A * | 4/2000 | Yoshikawa et al. | 156/240 |
| 6,176,185 | B1 * | 1/2001 | Charlier et al. | 101/493 |
| 7,644,657 | B1 * | 1/2010 | Clark et al. | 101/41 |
| 7,644,660 | B1 * | 1/2010 | Clark et al. | 101/492 |
| 2002/0097280 | A1 * | 7/2002 | Loper et al. | 347/2 |
| 2003/0191256 | A1 * | 10/2003 | Hayashi | 526/204 |
| 2004/0142765 | A1 | 7/2004 | Kennedy, III et al. | |
| 2006/0196372 | A1 * | 9/2006 | Kennedy et al. | 101/35 |
| 2007/0006765 | A1 * | 1/2007 | Fenzi | 101/488 |
| 2007/0144364 | A1 * | 6/2007 | Hitchcock | 101/41 |
| 2008/0044587 | A1 * | 2/2008 | Maeno et al. | 427/487 |
| 2010/0175571 | A1 * | 7/2010 | Schaafsma et al. | 101/333 |
| 2012/0042798 | A1 * | 2/2012 | Bradley et al. | 101/450.1 |
| 2012/0044312 | A1 * | 2/2012 | Hirst | 347/172 |
| 2012/0262525 | A1 * | 10/2012 | Ohnishi | 347/102 |

FOREIGN PATENT DOCUMENTS

| | | | |
|---|---|---|---|
| JP | H10-202998 | A | 8/1998 |
| JP | 2002-526182 | A | 8/2002 |
| JP | 2003145997 | A * | 5/2003 |
| JP | 2004-058599 | A | 2/2004 |
| JP | 2008-044235 | A | 2/2008 |
| JP | 2008-119934 | A | 5/2008 |
| WO | WO00/20219 | A1 | 4/2000 |

OTHER PUBLICATIONS

Notification of First Office action including Search Report, issued from the State Intellectual Property Office of the People's Republic of China in corresponding Application No. 201180023400.9, dated Apr. 29, 2014, 28 pages including translation.

Notification of Reason for Rejection, issued from the Japanese Patent Office in counterpart Application No. 2012-504465, dated Apr. 25, 2013, 8 pages including translation.

Notification of Preliminary Rejection, issued from the Korean Patent Office, in counterpart Application No. 10-2012-7023771, dated Nov. 27, 2013, 9 pages including translation.

Notification of the Second Office Action, issued from the State Intellectual Property Office of the People's Republic of China in corresponding Application No. 201180023400.9, dated Nov. 17, 2014, 10 pages including translation.

* cited by examiner

IMAGING DEVICE AND IMAGING METHOD

TECHNICAL FIELD

The present invention relates to an image forming device and image forming method that forms an image on a medium formed with a curved surface.

BACKGROUND TECHNOLOGY

Pad printing is an example of a conventional method for forming an image on a medium. In pad printing, the following procedure for forming an image is known: (1) a flat master plate (intaglio plate) on which a printing pattern is formed is prepared; (2) ink is pressed into the printing pattern of this flat master plate; (3) an elastic transfer pad is pressed against the flat master plate from above to transfer the ink in the printing pattern to the transfer pad; and (4) the transfer pad is pressed against the medium to transfer the ink from the transfer pad to the medium.

In another known method used in recent times, an image is formed on a medium in the following manner: (1) ink is applied to a flat master plate using an ink jet printer; (2) the ink on the flat master plate is thickened; (3) an elastic transfer pad is pressed against the flat master plate from above to transfer the ink in the printing pattern to the transfer pad; and (4) the transfer pad is pressed against the medium to transfer the ink from the transfer pad to the medium. (For example, see Patent Document 1.)

BACKGROUND TECHNOLOGY DOCUMENT

Patent document

[Patent Document 1] Japanese Laid-Open Patent Publication Number Hei 10-202998

SUMMARY OF THE INVENTION

Problems to be Solved by the Invention

In conventional pad printing, it has been necessary to produce a flat master plate. This makes it difficult to provide, for example, quick and low-cost small runs of different types of curved-surface printing jobs. Furthermore, the need to perform two transfer operations results in increased printing time as well as more color registration errors and transfer bleeds.

One possible pad printing method (not public knowledge) is to directly apply ink to the transfer pad using an ink-jet printer. Since this pad printing method would not require a flat master plate for printing, it has the advantage of allowing a variety of small-run curved-surface printing jobs to be handled easily.

However, since the transfer pad would be formed with a three-dimensional structure, the gap between the ink-jet head and the transfer pad would be increased. With ink-jet printers, the ink droplet placement accuracy generally decreases when the gap increases. As a result, this pad printing method would involve major restrictions in the surface shape of the transfer pad as well as the inability to print high-quality images.

The object of the present invention is to overcome these problems and to provide an image forming device and image forming method that allows high-quality images to be formed on a variety of media quickly and at low cost.

Means for Solving the Problems

The image forming method according to the present invention is an image forming method that forms an image on a medium. The method includes: a discharging step wherein ink is discharged from ink discharging means and the ink is applied to an elastic transfer sheet held in a flat state; and a transferring step wherein the transfer sheet is deformed, an ink application surface of the transfer sheet on which the ink was applied in the discharging step is pressed against the medium, and the ink applied to the transfer sheet is transferred to the medium.

With the image forming method according to the present invention, the transfer sheet onto which ink is applied by ink discharging means is kept in a flat state, thus keeping the gap between ink discharging means and the transfer sheet uniform. As a result, it is possible to prevent distortions in the image formed on the transfer sheet during the discharging step. Furthermore, in the transferring step, an elastic sheet is deformed to press the ink application surface against the medium so that the transfer sheet forms a tight contact with the surface of the medium. As a result, images can be formed by transferring ink to media with different shapes. Also, since an image can be formed on a medium with a single transfer operation in this manner, it is possible to reduce image forming time as well as to prevent color registration errors and transfer bleeds. Furthermore, since the need to create a printing master as in conventional pad printing methods is eliminated, it is possible to reduce costs while small-run printing of different types of jobs can be easily handled.

With this configuration, it would be preferable to further include, subsequent to the transferring step, a fusing step wherein the ink transferred to the medium is fused. By fusing the ink transferred to the medium in this manner, it is possible to prevent the ink formed on the medium from peeling.

Also, it would be preferable to further include a thickening step preceding the transferring step wherein the ink applied to the transfer sheet is thickened. By thickening the ink applied to the transfer sheet in this manner, it is possible to prevent the ink from bleeding from being crushed when the ink application surface is pressed against the medium by transferring means in the next step. As a result, a high-quality image with little bleeding of ink can be formed on the medium even if an ink with a low viscosity is discharged in the discharging step.

The following would also be preferable: in the discharging step, ink discharging means discharges an ultraviolet-curing ink that is cured through exposure to ultraviolet rays; in the thickening step, ultraviolet rays are emitted onto the ink application surface and the ultraviolet-curing ink applied to the transfer sheet is thickened; and in the fusing step, ultraviolet rays are emitted onto the medium and the ultraviolet-curing ink transferred to the medium undergoes final curing. By using ultraviolet-curing ink in this manner, it is possible to easily thicken the ultraviolet-curing ink by exposing it to ultraviolet rays, and the ultraviolet-curing ink can easily undergo final curing to be fused to the medium.

With this configuration, it would be preferable in the thickening step for the viscosity of the ultraviolet-curing ink to be in a range of 30 to 300 mPa·sec at 25 deg C. By pre-curing the ultraviolet-curing ink to this viscosity range in the pre-curing step, it is possible to prevent excessive crushing and bleeding of the ink in the subsequent transfer step without reducing transfer quality from the pad member to the medium.

It would also be possible in the transferring step to arrange the elastic pad member facing the medium, interposed by the transfer sheet, and to move the pad member toward medium. By using this arrangement and moving the pad member toward the medium, it is possible to use the pad member to press the transfer sheet against the medium and to deform the pad member and the transfer sheet according to the shape of the medium. As a result, the transfer sheet is pressed tightly against the medium so that the ink applied to the transfer sheet can be transferred to the medium.

It would also be possible in the transferring step to provide an elastic bag-shaped member facing the medium, interposed by the transfer sheet, and to inflate the bag-shaped member. By using this arrangement and inflating the bag-shaped member, the inflated bag-shaped member can press the transfer sheet against the medium, and the bag-shaped member and the transfer sheet can be deformed according to the shape of the medium. As a result, the transfer sheet is pressed tightly against the medium so that the ink applied to the transfer sheet can be transferred to the medium.

It would also be possible in the transfer step to: insert the medium in a container that is formed with an opening; to cover the opening with the ink application surface; and to decompress the container. With this configuration, the medium is inserted in the container and the opening of the container is covered with the ink application surface, thus sealing the container with the medium facing the ink application surface. By decompressing the container in this state, the negative pressure causes the transfer sheet to be deformed and sucked in toward the container. This results in the ink application surface being tightly pressed against the medium surface so that the ink applied to the transfer sheet can be transferred to the medium.

It would also be preferable to include, subsequent to the transferring step, a cleaning step wherein the ink application surface is cleaned. By cleaning the ink application surface in the cleaning step, debris adhesed to the ink application surface and residual ink on the ink application surface that was not transferred can be removed. This allows the quality of the image transferred to the medium to be improved.

An image forming device according to the present invention is an image forming device that forms an image on a medium. The image forming device includes: a transfer sheet unit that uses a frame to hold an elastic transfer sheet in a flat state; ink discharging means that discharges ink and applies the ink to the transfer sheet; and transferring means pressing against the medium an ink application surface of the transfer sheet on which the ink has been applied by ink discharging means.

With the image forming device according to the present invention, the transfer sheet to which ink has been applied by ink discharging means is kept in a flat state by a frame. Thus, a uniform gap is provided between ink discharging means and the transfer sheet. As a result, it is possible to prevent distortions in the image formed on the transfer sheet by ink discharged from ink discharging means. Since the transfer sheet is elastic, the transfer sheet is deformed and pressed tightly against the medium surface when transferring means presses the ink application surface against the medium. As a result, images can be formed through the transfer of ink on variously shaped media. Since an image can be formed on a medium with a single transfer operation, the time required to form the image can be reduced, and color registration errors and transfer bleeds can be prevented. Furthermore, the need to produce a master plate for printing required for conventional pad printing is eliminated, thus making it possible to reduce costs while allowing different types of small-run printing jobs to be handled easily.

In this configuration, it would be preferable to further include fusing means to fuse the ink transferred to the medium. With this configuration, the ink transferred to the medium is fused so that peeling of the ink formed on the medium can be prevented.

It would also be preferable to further include thickening means to thicken the ink applied to the transfer sheet. By thickening the ink applied to the transfer sheet in this manner, it is possible to prevent ink bleeds resulting from excessive crushing of the ink when the ink application surface is pressed against the medium. As a result, a high-quality image with minimal ink bleeds can be formed on the medium even if ink discharging means discharges low-viscosity ink.

The following configuration would be preferable: ink discharging means discharges an ultraviolet-curing ink that is cured by exposure to ultraviolet rays; thickening means is a pre-curing ultraviolet-ray emitting device that emits ultraviolet rays onto the ink application surface and thickens the ultraviolet-curing ink applied to the transfer sheet; and fusing means is a final curing ultraviolet-ray emitting device that emits ultraviolet rays onto the medium and subjects the ultraviolet-curing ink transferred to the medium to final curing. By using ultraviolet-curing ink and emitting ultraviolet rays, the ultraviolet-curing ink can be easily thickened and the ultraviolet curing ink can be easily subjected to final curing to fuse it to the medium.

Transferring means can also be equipped with an elastic pad member that is provided facing the transfer sheet, interposed by the medium, and that is held in a manner that allows movement toward the medium. By moving the pad member provided in this manner toward the medium, the pad member can push the transfer sheet against the medium, and the pad member and the transfer sheet can be deformed according to the shape of the medium. As a result, the transfer sheet is pressed tightly against the medium to allow the ink applied to the transfer sheet to be transferred to the medium.

The pad member can be provided opposite from the transfer sheet on the other side of ink discharging means. By providing the pad member opposite from the transfer sheet on the other side of ink discharging means, the pad member is provided opposite from the ink application surface on the other side of the transfer sheet, thus allowing the ink applied to the transfer sheet to be transferred to the medium by moving the pad member without reversing the frame holding the transfer sheet.

The transfer sheet unit can be held in a reversible manner, and the pad member can be provided on the same side of the transfer sheet as ink discharging means. By holding the transfer sheet unit in a reversible manner, the ink application surface of the transfer sheet can be made to face the medium even if the pad member is provided on the same side of the transfer sheet as ink discharging means. As a result, the image forming device can be designed with a greater degree of freedom.

Also, transferring means can be equipped with: an elastic bag-shaped member provided facing the medium, interposed by the transfer sheet; and inflating means that inflates the bag-shaped member. By inflating the bag-shaped member provided in this manner, the inflated bag-shaped member can press the transfer sheet against the medium, and the bag-shaped member and the transfer sheet can be deformed according to the shape of the medium. As a result, the transfer sheet can be pressed tightly against the medium, thus allowing the ink applied to the transfer sheet to be transferred to the medium.

Also, transferring means can be equipped with: a container formed with an opening that is covered by the ink application surface and into which the medium is inserted; and decompressing means that decompresses the container. With this configuration, the medium is inserted in the container and the opening of the container is covered with the ink application surface, thus sealing the container with the medium facing the ink application surface. By decompressing the container in this state, the negative pressure causes the transfer sheet to be deformed and sucked in toward the container. This results in the ink application surface being tightly pressed against the medium surface so that the ink applied to the transfer sheet can be transferred to the medium.

It would be preferable for the frame to be formed in the shape of a ring. By forming the frame in the shape of a ring, it is possible to apply a uniform stress along the perimeter to deform the transfer sheet. As a result, distortion from expansion and shrinkage of the ink application surface can be made uniform, thus limiting distortions in the image transferred to the medium.

The frame can also be formed as a polygonal ring. When forming the frame as a polygonal ring, it would be preferable to further include tension adjusting means to adjust the tension acting on the transfer sheet. For example, this tension adjust means can be configured so that at least one side of the frame is movable, with the tension on the transfer sheet being adjusted by moving this side. Alternatively, the tension on the transfer sheet can be adjusted by moving a jig that holds the frame. This prevents distortions in the image transferred to the medium even when using a frame shaped as a polygonal ring.

It would be preferable to further include cleaning means that cleans the ink application surface. By cleaning the ink application surface with cleaning means, debris adhesed to the ink application surface and residual ink on the ink application surface that was not transferred can be removed. This allows the quality of the image transferred to the medium to be improved.

Advantage of the Invention

With the present invention, high-quality images can be formed quickly and at low cost on various types of media.

BRIEF DESCRIPTION OF THE DRAWINGS

FIG. 3 FIG. 3A and FIG. 3B show a transfer sheet unit. FIG. 3A is a top-view drawing. FIG. 3B is a cross-section drawing (vertical cross-section drawing) along the b-b line from FIG. 3A.

FIG. 4 FIG. 4A and FIG. 4B show an example of a structure for a transfer sheet unit. FIG. 4A is a vertical cross-section drawing. FIG. 4B is a cross-section drawing (horizontal cross-section drawing) along the b-b line from FIG. 4A.

FIG. 7 FIG. 7A to FIG. 7C are drawings showing examples of operations performed by an ink-jet printer.

FIG. 8 FIG. 8A to FIG. 8C are drawings showing examples of operations performed by an ink-jet printer.

FIG. 12 FIG. 12A to FIG. 12C are drawings showing examples of operations performed by an ink-jet printer.

FIG. 13 FIG. 13A to FIG. 13C are drawings showing examples of operations performed by an ink-jet printer.

FIG. 17 FIG. 17A to FIG. 17C are drawings showing examples of operations performed by an ink-jet printer.

FIG. 18 FIG. 18A to FIG. 18C are drawings showing examples of operations performed by an ink-jet printer.

FIG. 23 FIG. 23A to FIG. 23C are drawings showing examples of operations performed by an ink-jet printer.

FIG. 24 FIG. 24A to FIG. 24C are drawings showing examples of operations performed by an ink-jet printer.

EMBODIMENTS OF THE INVENTION

Figure 1:
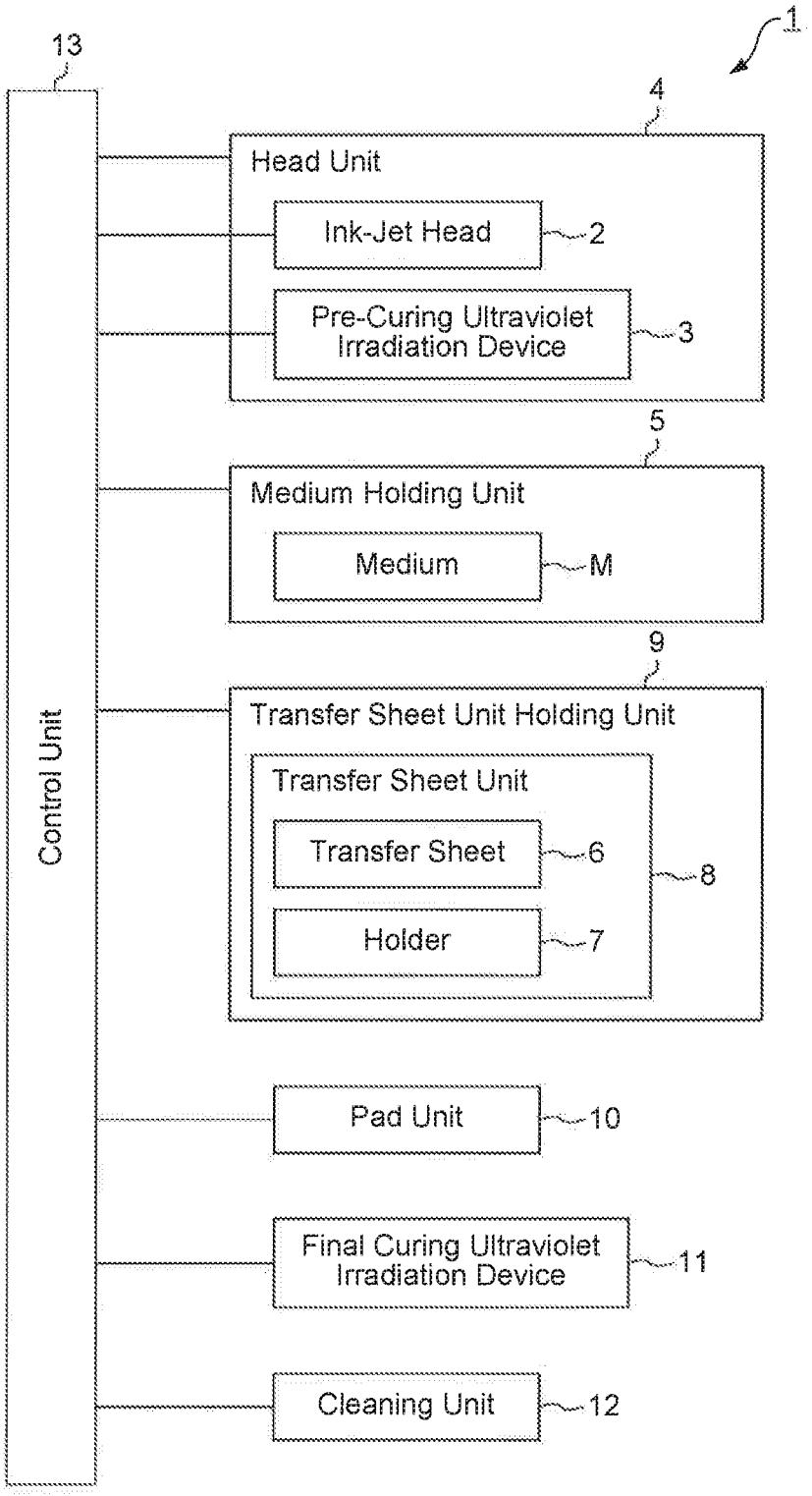
FIG. 1 A functional diagram of an ink-jet printer according to a first embodiment.

Referring to the drawings, the preferred embodiments for the image forming method and the image forming device according to the present invention will be described in detail. An ink-jet printer according to this embodiment forms an image on a medium formed with a curved surface and discharges an ultraviolet-curing ink that is cured when exposed to ultraviolet rays. In this embodiment, an image is formed on a spherical medium. In the figures, identical or corresponding parts are assigned the same numerals.

First Embodiment

Figure 2:
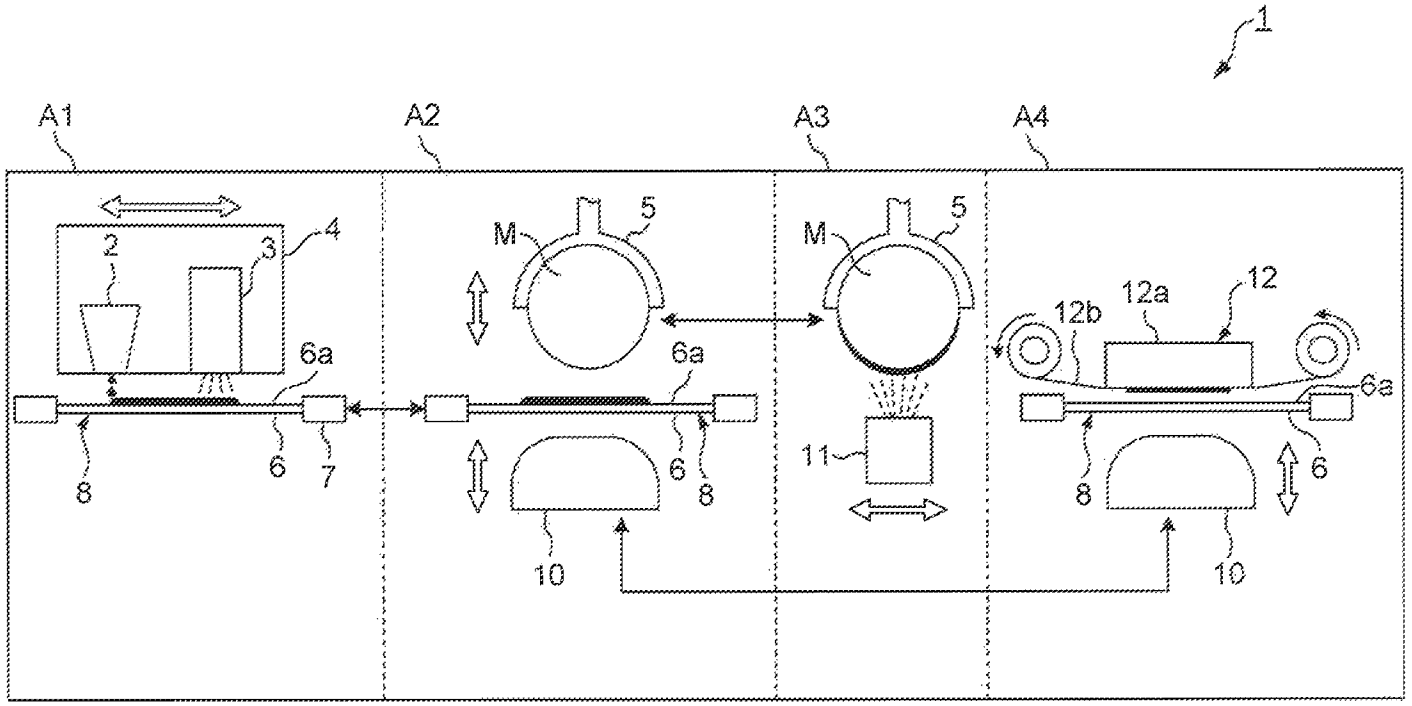
FIG. 2 A simplified drawing showing the arrangement of elements in the ink-jet printer from FIG.

FIG. 1 is a functional diagram of an ink-jet printer according to the first embodiment. FIG. 2 is a simplified drawing showing the arrangement of elements in the ink-jet printer from FIG. 1. As shown in FIG. 1 and FIG. 2, an ink-jet printer 1 is equipped with: an ink-jet head 2; a pre-curing ultraviolet irradiation device 3; a head unit 4 in which is installed the ink-jet head 2 and the pre-curing ultraviolet irradiation device 3; a medium holding unit 5 that holds a medium M; a transfer sheet unit holding unit 9 that holds a transfer sheet unit 8, in which a transfer sheet 6 is mounted to a transfer sheet holder 7; a pad unit 10; a final curing ultraviolet irradiation device 11; a cleaning unit 12; and a control unit 13.

This ink-jet printer 1 is divided into four regions, i.e., a first area A1 to a fourth area A4. The first area A1 is a region in which an ultraviolet-curing ink is applied to the transfer sheet 6 and the ultraviolet-curing ink applied to the transfer sheet 6 is pre-cured (thickened). The second area A2 is a region in which the ultraviolet-curing ink applied to the transfer sheet 6 is transferred to the medium M. The third area A3 is a region in which the ultraviolet-curing ink transferred to the medium M undergoes final curing so that it is fused to the medium M. The fourth area A4 is a region in which the transfer sheet 6 is cleaned.

This is achieved through the following configuration: the head unit 4 is provided in the first area A1; the medium holding unit 5 is capable of moving between the second area A2 and the third area A3; the transfer sheet unit holding unit 9 is capable of moving either automatically or manually between the first area A1, the second area A2, and the fourth area A4; the pad unit 10 is capable of moving between the second area A2 and the fourth area A4; the final curing ultraviolet irradiation device 11 is provided in the third area A3; and the cleaning unit 12 is provided in the fourth area A4.

The transfer sheet unit 8, which is held below the head unit 4 by the transfer sheet unit holding unit 9 is provided in the first area A1. In the second area A2, the medium M is held by the medium holding unit 5 above the transfer sheet unit 8 held by the transfer sheet unit holding unit 9, and the pad unit 10 is provided below the transfer sheet unit 8 held by the transfer sheet unit holding unit 9. In the third area A3, the final curing ultraviolet irradiation device 11 is provided below the medium M held by the medium holding unit 5. In the fourth area A4, the cleaning unit 12 is provided above the transfer sheet unit 8 held by the transfer sheet unit holding unit 9, and the pad unit 10 is provided below the transfer sheet unit 8 held by the transfer sheet unit holding unit 9. The separation between the first area A1 to the fourth area A4 can be either physical or functional.

The configuration of the ink-jet printer 1 will be described in detail.

The ink-jet head 2 is an ink discharge device that discharges an ultraviolet-curing ink. The ultraviolet-curing ink discharged by the ink-jet head 2 is an ink that is cured when exposed to ultraviolet rays. Various types of ink such as cationic polymer inks, radical polymer inks, and inks that are a mix of cationic polymers and radical polymers can be used. The viscosity of this ultraviolet-curing ink is adjusted to be within a range of 3 to 20 mPa·sec at 25 deg C. in order to allow the ink to be discharged from the ink-jet head 2. As long as the curing through ultraviolet ray exposure is not inhibited, the ultraviolet-curing ink can contain 70 percent by weight or less of a solvent to adjust viscosity. There are no special restrictions on the color of the ultraviolet-curing ink. For example, it would be possible to use the standard colors, Y (yellow), M (magenta), C (cyan), and K (black), special colors thereof, e.g., pale, white, metallic, or clear, or combinations of these.

The pre-curing ultraviolet irradiation device 3, which is equipped with a UV LED that emits ultraviolet rays, is an ultraviolet radiation device that emits ultraviolet rays downward at an intensity that results in pre-curing (thickening) of the ultraviolet-curing ink. This pre-curing ultraviolet irradiation device 3 emits ultraviolet rays with relatively long wavelengths of 350 nm to 410 nm. More specifically, if the ultraviolet rays emitted by the pre-curing ultraviolet irradiation device 3 have short wavelengths of less than 350 nm, the ultraviolet rays will tend not to reach inside the ultraviolet-curing ink, resulting in insufficient exposure and inadequate pre-curing, of the ultraviolet-curing ink. By emitting ultraviolet rays with the abovementioned wavelengths, the pre-curing ultraviolet irradiation device 3 can provide ultraviolet rays that reach inside the ultraviolet-curing ink.

The head unit 4 is supported by a drive unit (not shown in the drawings) to allow movement along a scanning direction. The ink-jet head 2 is provided on the head unit 4 toward the front along the scanning direction and the pre-curing ultraviolet irradiation device 3 is provided on the head unit 4 toward the rear along the scanning direction. As a result, when head unit 4 moves along the scanning direction, the ultraviolet-curing ink is discharged from the ink-jet head 2 and ultraviolet rays are emitted from the pre-curing ultraviolet irradiation device 3. This makes it possible to apply the ultraviolet-curing ink to the transfer sheet 6 and to provide pre-curing (thickening) on this applied ultraviolet-curing ink in one step.

The medium holding unit 5 uses suction or the like to hold the medium M from above. The medium holding unit 5 is configured to be movable and can move the medium M between the second area A2 and the third area A3. Also, in the second area A2, the medium holding unit 5 can be moved downward so that the medium M is pressed against the transfer sheet 6.

The transfer sheet unit holding unit 9 holds the transfer sheet unit 8. The transfer sheet unit holding unit 9 is configured to be movable and can move the transfer sheet unit 8 between the first area A1, the second area A2, and the fourth area A4.

Figure 3A:
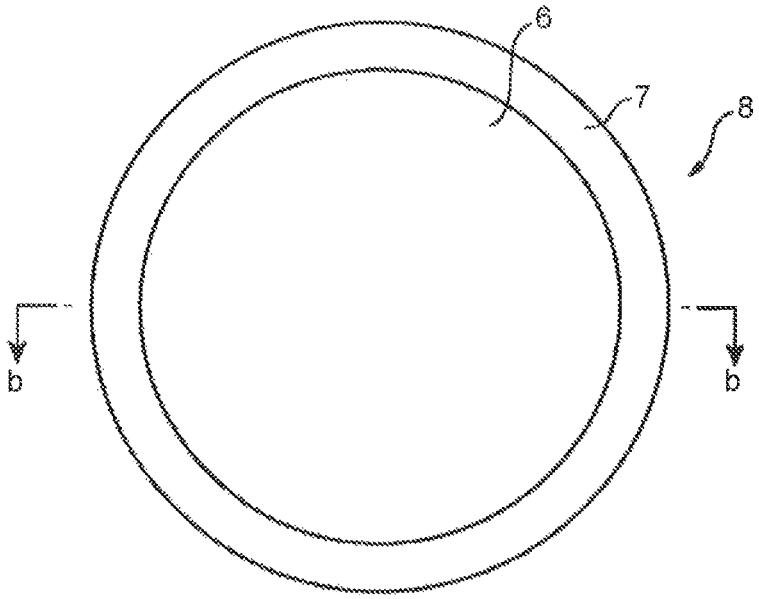
Figure 3B:
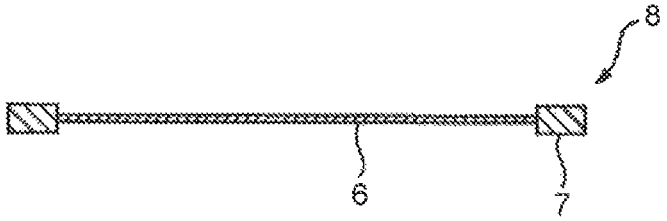

FIG. 3A and FIG. 3B show the transfer sheet unit. FIG. 3A is a top-view drawing. FIG. 3B is a cross-section drawing (vertical cross-section drawing) along the b-b line from FIG. 3A. As shown in FIG. 3A and FIG. 3B, the transfer sheet unit 8 is formed from the transfer sheet 6 and the transfer sheet holder 7. The transfer sheet holder 7 supports the transfer sheet 6 in a flat state.

Figure 4A:
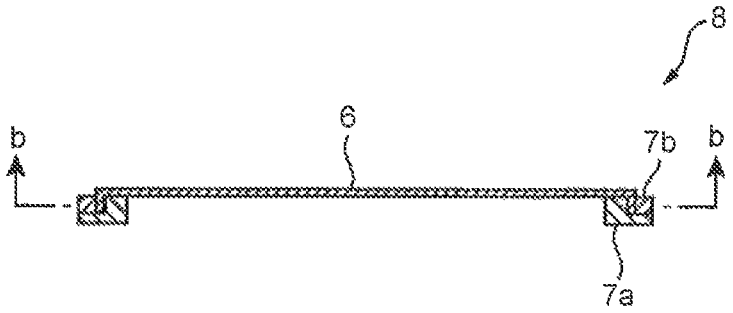
Figure 4B:
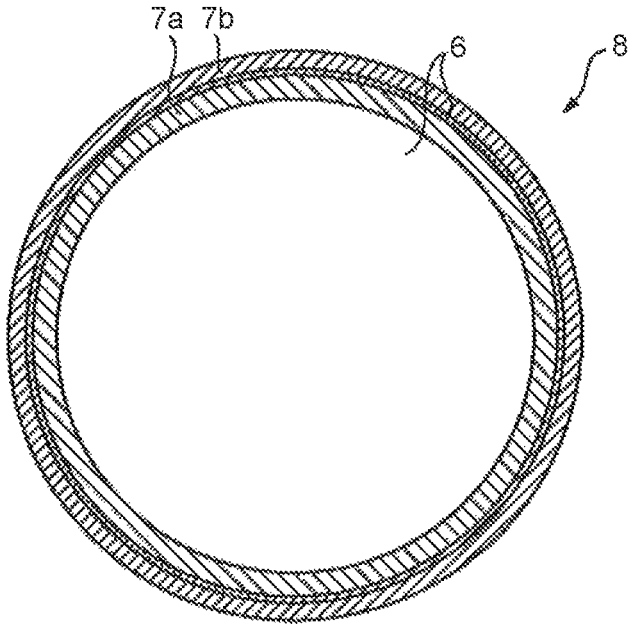

FIG. 4A and FIG. 4B show an example of a structure for a transfer sheet unit. FIG. 4A is a vertical cross-section drawing. FIG. 4B is a cross-section drawing (horizontal cross-section drawing) along the b-b line from FIG. 4A. As shown in FIG. 4A and FIG. 4B, the transfer sheet unit 8 can, for example, have a split structure formed from an inner ring holder 7*a* and an outer ring holder 7*b* in order to allow the transfer sheet 6 to be held easily. This inner ring holder 7*a* is formed with an L-shaped cross section with a cut-out formed on one side of the outer perimeter section. The outer ring holder 7*b* is formed with a rectangular cross section that fits into the cut-out of the inner ring holder 7*a*. The transfer sheet 6 can be held by the inner ring holder 7*a* and the outer ring holder 7*b* by fitting the outer ring holder 7*b* to the cut-out of the inner ring holder 7*a* with the transfer sheet 6 being placed at the cut-out of the inner ring holder 7*a*.

The transfer sheet 6 is formed as a thin sheet made from an elastic material such as silicone rubber. As a result, the shape of the transfer sheet 6 can be changed through stretching or contraction caused by an external force.

The transfer sheet holder 7, like a frame used in silkscreen printing, is formed in the shape of a ring with a rectangular cross section from a material with a high degree of rigidity such as metal. As a result, the transfer sheet holder 7 keeps its original shape with almost no deformation even if an external force acts on the transfer sheet 6.

The pad unit 10 is formed in the shape of an upwardly projected dome from an elastic material such as rubber or sponge. Also, the pad unit 10 is supported in a manner that allows movement. As a result, when the pad unit 10 moves upward in the second area A2, it presses against the medium M while deforming the transfer sheet 6 and is deformed in the shape of the surface of the medium M. As a result, the pad unit 10 can be pressed against the medium M while the transfer sheet 6 is pressed tightly against the medium M.

The final curing ultraviolet irradiation device 11, which is equipped with a UV LED that emits ultraviolet rays, is an ultraviolet radiation device that emits ultraviolet rays downward at an intensity that results in final curing of the ultraviolet-curing ink. Like the pre-curing ultraviolet irradiation device 3, the final curing ultraviolet irradiation device 11 emits ultraviolet rays with relatively long wavelengths of 350 nm to 410 nm. Like the head unit 4, the final curing ultraviolet irradiation device 11 is supported by a drive unit (not shown in the drawings) to allow movement along a scanning direction.

The cleaning unit 12 cleans the transfer sheet 6. The cleaning unit 12 is formed from an elastic pressing member 12*a* and a long cleaning sheet 12*b*. The cleaning unit 12 moves the pressing member 12*a* downward to press it against the transfer sheet 6 and drives the cleaning sheet 12*b* while this state is maintained, thereby wiping off residual ultraviolet-curing ink on the transfer sheet 6, debris adhesed to the transfer sheet 6, and the like.

The control unit 13 provides unified control over the ink jet printer 1 and performs transfer printing of a predetermined image to the medium M.

Figure 5:
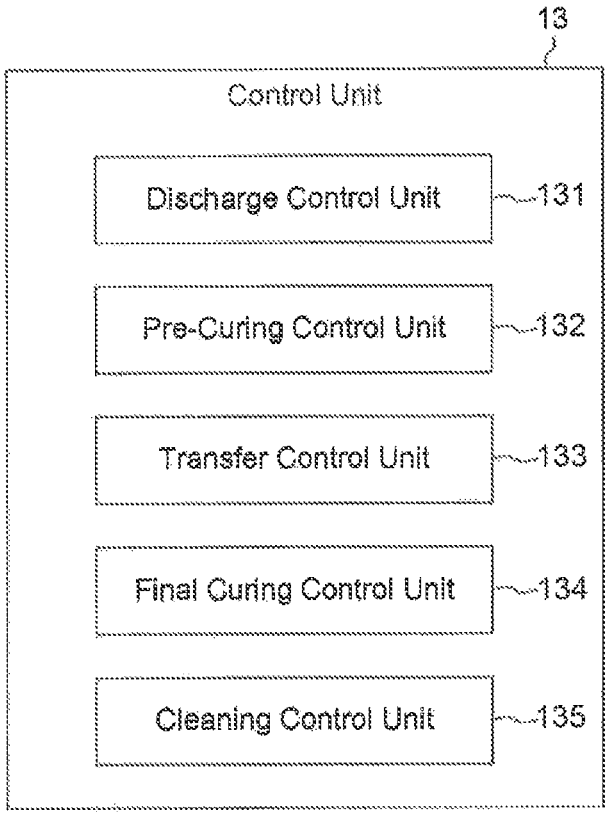
FIG. 5 A functional diagram of a control unit.

FIG. 5 is a functional diagram of a control unit. As shown in FIG. 5, the control unit 13 functions as a discharge control unit 131, a pre-curing control unit 132, a transfer control unit 133, a final curing control unit 134, and a cleaning control unit 135. The control unit 13 can be formed, for example, around a computer that includes a CPU, a ROM, and a RAM, with computer programs that implement these functions being stored in the ROM. These functions are then realized by having these computer program read by the CPU or the RAM and executed under the control of the CPU.

The discharge control unit 131 performs a discharging operation wherein ultraviolet-curing ink is discharged from the ink jet head 2 and the ultraviolet-curing ink is applied to the transfer sheet 6. More specifically, the discharge control unit 131 moves the transfer sheet unit holding unit 9 to the first area A1. Then, the discharge control unit 131 discharges the ultraviolet-curing ink from the ink-jet head 2 while moving the head unit 4 in a scanning direction.

The pre-curing control unit 132 provides a pre-curing operation that pre-cures (thickens) the ultraviolet-curing ink applied to the transfer sheet 6. More specifically, the pre-curing control unit 132 emits ultraviolet rays from the pre-curing ultraviolet irradiation device 3 while the head unit 4 is being moved in the scanning direction by the discharging operation performed by the discharge control unit 131. During this operation, the pre-curing control unit 132 controls the movement velocity of the head unit 4 and the intensity of the ultraviolet rays emitted by the pre-curing ultraviolet irradiation device 3 so that the viscosity of the ultraviolet-curing ink at 25 deg C. is increased to a range of 30 to 300 mPa·sec.

The transfer control unit 133 provides a transferring operation wherein the ultraviolet-curing ink applied to the transfer sheet 6 is transferred under pressure to the medium M. More specifically, the transfer control unit 133 moves the medium holding unit 5, the transfer sheet unit holding unit 9, and the pad unit 10 to the second area A2. The transfer control unit 133 then moves the medium holding unit 5 downward while moving the pad unit 10 upward so that the pad unit 10 is pressed against the medium M. It would also be possible for the transfer control unit 133 to move, just the pad unit 10 upward to press the pad unit 10 against the medium M without moving the medium holding unit 5. Furthermore, it would be possible for the transfer control unit 133 to heat the medium M and the transfer sheet 6 when performing transfer operation in order to improve adhesion between the transfer sheet 6 and the medium M and to improve the flexibility of the transfer sheet 6.

The final curing control unit 134 performs a final curing operation to cure the ultraviolet-curing ink transferred to the medium M. More specifically, the final curing control unit 134 moves the medium holding unit 5 to the third area A3. The final curing control unit 134 then causes ultraviolet rays to be emitted from the final curing ultraviolet irradiation device 11 while moving the final curing ultraviolet irradiation device 11 in the scanning direction. During this operation, the final curing control unit 134 controls the movement velocity of the final curing ultraviolet irradiation device 11 and the intensity of the ultraviolet rays emitted by the final curing ultraviolet irradiation device 11 so that the ultraviolet-curing ink is completely cured.

The cleaning control unit 135 provides a cleaning operation for cleaning the transfer sheet 6. More specifically, the cleaning control unit 135 moves the transfer sheet unit holding unit 9 and the pad unit 10 to the fourth area A4. The cleaning control unit 135 then moves the pad unit 10 upward while moving the pressing member 12*a* downward, and the cleaning sheet 12*b* is driven while the transfer sheet 6 and cleaning sheet 12*b* are interposed between the pressing member 12*a* and the pad unit 10.

Figure 6:
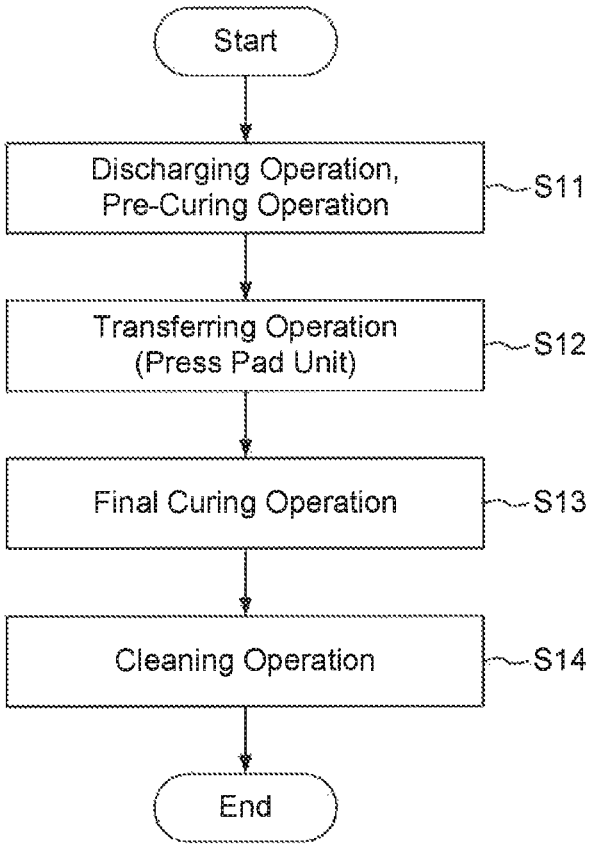
FIG. 6 A flowchart showing operations performed by the control unit.

Referring to FIG. 2, FIG. 6, FIG. 7A to FIG. 7C, and FIG. 5A to FIG. 8C, a transfer printing method that uses the ink-jet printer 1 will be described next. FIG. 6 is a flowchart showing operations performed by the control unit. FIG. 7A to FIG. 7C and FIG. 8A to FIG. 8C are drawings showing examples of operations performed by an ink-jet printer. The control unit 13 implements the operations described below with a processing unit (not shown in the drawings) formed from a CPU or the like that executes a computer program recorded in a storage device such as a ROM.

First, when performing transfer printing, the control unit 13 heats the medium M and the transfer sheet 6.

Figure 7A:
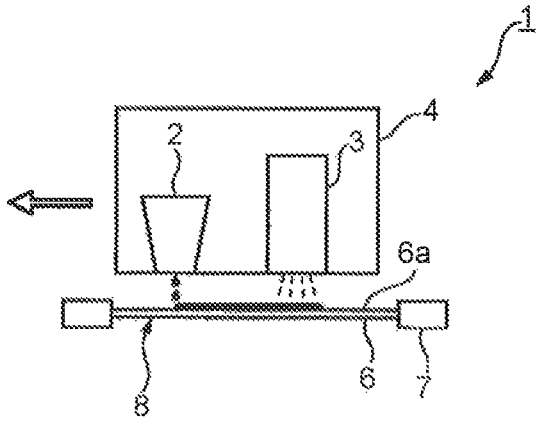

Next, the control unit 13 performs the discharging operation and the pre-curing operation to apply the ultraviolet-curing ink to the transfer sheet 6 and to pre-cure the applied ultraviolet-curing ink (step S11). More specifically, first, at step S11, the transfer sheet unit holding unit 9 is moved to the first area A1 and the transfer sheet unit 8 is positioned below the head unit 4 as shown in FIG. 2 and FIG. 7A. Then, while the head unit 4 is moved in the scanning direction, ultraviolet-curing ink is discharged from the ink-jet head 2 and ultraviolet rays are emitted from the pre-curing ultraviolet irradiation device 3. This causes the ultraviolet-curing ink discharged from the ink-jet head 2 to be applied to the transfer sheet 6, with the ultraviolet-curing ink applied to the transfer sheet 6 being exposed to the ultraviolet rays emitted from the pre-curing ultraviolet irradiation device 3. During this operation, the control unit 13 controls the movement velocity of the pre-curing ultraviolet irradiation device 3 and the intensity of the ultraviolet rays emitted by the pre-curing ultraviolet irradiation device 3 so that the ultraviolet-curing ink on the medium M is pre-cured and thickened to a viscosity in the range of 30 to 300 mPa·sec. As a result, the ultraviolet-curing ink applied to the transfer sheet 6 is thickened to a viscosity in the range of 30 to 300 mPa·sec at 25 deg C. Since the ink-jet head 2 is provided above the transfer sheet 6, the upper surface of the transfer sheet 6 serves as an ink application surface 6*a* upon which ink is applied.

Figure 7B:
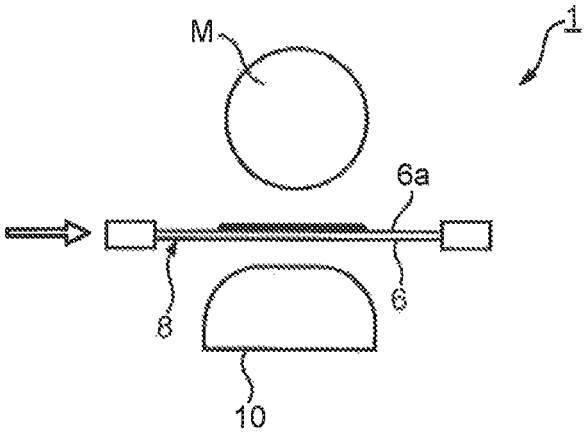

Next, the control unit 13 performs a transferring operation wherein the ultraviolet-curing ink applied to the transfer sheet 6 is transferred to the medium M (step S12). More specifically, first, at step S12, the medium holding unit 5, the transfer sheet unit holding unit 9, and the pad unit 10 are moved to the second area A2 as shown in FIG. 2 and FIG. 7B. Then, the medium M is positioned above the transfer sheet unit 8 and the pad unit 10 is positioned below the transfer sheet unit 8 so that the medium M and the pad unit 10 face each other, interposed by the transfer sheet unit 8.

Figure 7C:
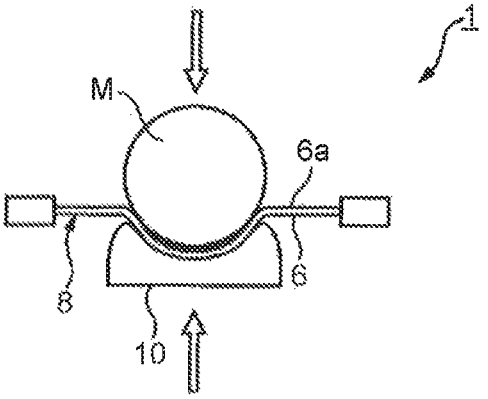

Then, when the medium M and the pad unit 10 face each other, interposed by the transfer sheet unit 8, the pad unit 10 is moved upward and the medium holding unit 5 is moved downward, as shown in FIG. 7C. The pad unit 10 is then pushed against the medium M with the transfer sheet 6 interposed, and the pad unit 10 and the transfer sheet 6 are deformed in the shape of the medium M. As a result, the elastic force of the pad unit 10 pushes the transfer sheet 6 against the medium M, with the ink application surface 6*a* thereof being pressed tightly against the medium M. At this time, the ultraviolet-curing ink is thickened but has not undergone final curing and is still a soft paste. As a result, the ultraviolet-curing ink is flattened by the transfer sheet 6 being pressed against the medium M.

Figure 8A:
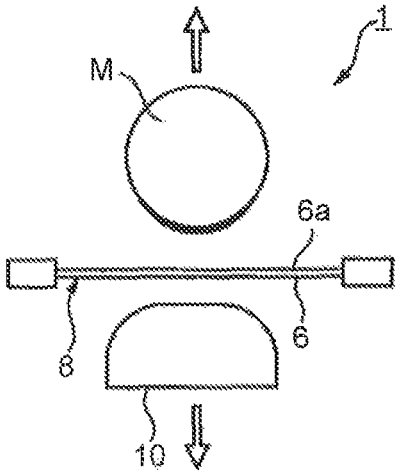

As shown in FIG. 8A, the pad unit 10 is then moved downward and returned to its original position and the medium holding unit 5 is moved upward and returned to its original position. As a result, the ultraviolet-curing ink applied to the transfer sheet 6 is transferred to the medium M. In this operation, the ultraviolet-curing ink, which is flattened by the pressing of the transfer sheet 6 against the medium M, is transferred to the medium M. As a result, a glossy image with a flattened surface is formed on the medium M. It would also be possible to form a matte image by roughening the surface of the transfer sheet 6.

At step S12, it would also be possible to transfer the ultraviolet-curing ink from the transfer sheet 6 to the medium M by only moving the pad unit 10 up and down without moving the medium holding unit 5.

Figure 8B:
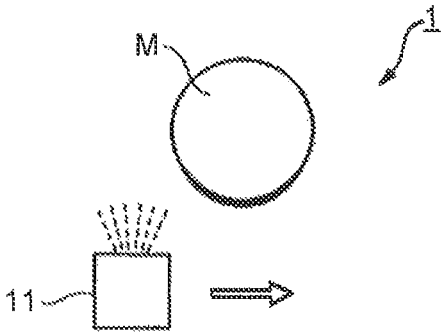

Next, the control unit 13 performs the final curing operation to subject the ultraviolet-curing ink transferred to the medium M to final curing (step S13). More specifically, first, at step S13, the medium holding unit 5 is moved to the third area A3 and the medium M is positioned above the final curing ultraviolet irradiation device 11 as shown in FIG. 2 and FIG. 8B.

Then, when the medium M is positioned above the final curing ultraviolet irradiation device 11, ultraviolet rays are emitted from the final curing ultraviolet irradiation device 11 while the final curing ultraviolet irradiation device 11 is moved in the scanning direction. During this operation, the control unit 13 controls the movement velocity of the final curing ultraviolet irradiation device 11 and the intensity of the ultraviolet rays emitted by the final curing ultraviolet irradiation device 11 so that the ultraviolet-curing ink on the medium M undergoes final curing. As a result, the ultraviolet-curing ink transferred to the medium M is exposed to ultraviolet rays, undergoes final curing, and is fused to the medium M.

Figure 8C:
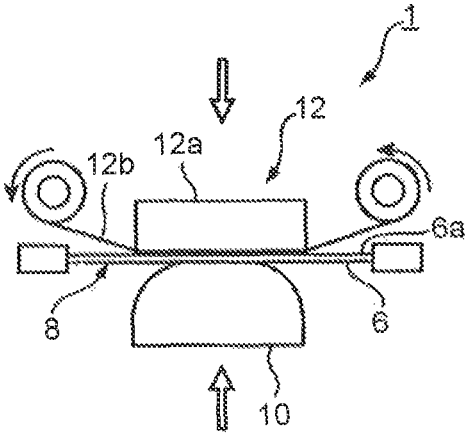

Next, the control unit 13 performs a cleaning operation to clean the transfer sheet 6 (step S14). More specifically, first, at step S14, the transfer sheet unit holding unit 9 and the pad unit 10 are moved to the fourth area A4 as shown in FIG. 2 and FIG. 8C. Then, the transfer sheet unit 8 is positioned below the cleaning unit 12 and the pad unit 10 is positioned below the transfer sheet unit 8 so that the cleaning unit 12 faces the pad unit 10 with the transfer sheet unit 8 being interposed therebetween.

With the cleaning unit 12 and the pad unit 10 facing each other and the transfer sheet unit 8 interposed therebetween, the pressing member 12*a* is then moved downward, the pad unit 10 is moved upward, and the cleaning sheet 12*b* is driven. Then, the transfer sheet 6 and the cleaning sheet 12*b* are interposed between the pad unit 10 and the pressing member 12*a*, with the ink application surface 6*a* of the transfer sheet 6 being rubbed by the cleaning sheet 12*b*. As a result, the cleaning sheet 12*b* wipes away debris adhesed to the transfer sheet 6 and residual ultraviolet-curing ink on the transfer sheet 6 that was not transferred to the medium M during the transfer operation at step S12.

In this embodiment, the transfer sheet 6 is kept flat by the transfer sheet holder 7 as described above, thus providing a uniform gap between the ink-jet head 2 and the transfer sheet 6. This makes it possible to prevent distortions in the image formed on the transfer sheet 6 by the ultraviolet-curing ink discharged from the ink-jet head 2. Also, since the transfer sheet 6 has elasticity, the pressing of the ink application surface 6*a* against the medium M by the pad unit 10 causes the transfer sheet 6 to deform and press tightly against the surface of the medium M. As a result, ink can be transferred and images can be formed on variously shaped media M. Also, since an image can be formed on the medium M with one transfer operation, it is possible to prevent image-forming times and limit color registration errors and transfer bleeds. Furthermore, there is no need to create master printing plates as in conventional pad printing. This makes it possible to reduce costs and to easily handle small runs of different types of printing.

Furthermore, since an ultraviolet-curing ink is used and this ultraviolet-curing ink is exposed to ultraviolet rays, it is easy to thicken the ultraviolet-curing ink applied to the transfer sheet 6 and fuse the transferred ultraviolet-curing ink to the medium M. In particular, ink-jet heads capable of printing high-quality images can only discharge inks with low viscosities of approximately 15 mPa·sec or less at room temperature or, depending on ink-jet head discharge conditions, 10 to 8 mPa·sec or 5 to 3 mPa·sec. By using the pre-curing ultraviolet irradiation device 3 to thicken the ultraviolet-curing ink applied to the transfer sheet 6, the ultraviolet-curing ink is prevented from bleeding as a result of being excessively crashed when the ink application surface 6*a* is pressed against the medium M in the following transfer step. As a result, it is possible to form a high-quality image on the medium M with minimal ink bleeding even if a low-viscosity ultraviolet ink is discharged during the discharging step. Furthermore, by fusing the ultraviolet-curing ink transferred to the medium M, it is possible to prevent the peeling of ultraviolet-curing ink formed on the medium M.

Also, by thickening the viscosity of the ultraviolet-curing ink applied to the transfer sheet 6 to 30 to 300 mPa·sec at 25 deg C. in the pre-curing step, it is possible to prevent the ink from being excessively crushed in the following transfer step without reducing the quality of transfer from the pad member to the medium.

Also, by pressing the transfer sheet 6 against the medium M using the pad unit 10, it is possible to transfer the ultraviolet-curing ink applied to the transfer sheet 6 to the medium Min a suitable manner.

By placing the pad unit 10 opposite from the ink-jet head 2 on the other side of the transfer sheet 6, the pad unit 10 is positioned opposite from the ink application surface 6*a* on the other side of the transfer sheet 6, thus allowing the ultraviolet-curing ink applied to the transfer sheet 6 to be transferred to the medium M without reversing the transfer sheet holder 7.

Also, by cleaning the ink application surface 6*a*, it is possible to remove debris adhesed to the ink application surface 6*a* and untransferred residual ink on the ink application surface 6*a*, thus allowing the quality of the image transferred to the medium M to be improved.

Also, by forming the transfer sheet holder 7 in the shape of a ring, it is possible to make the stress applied to deform the transfer sheet 6 uniform along the perimeter direction. As a result, distortion from expansion and shrinkage of the ink application surface 6*a* can be made uniform, thus limiting distortions in the image transferred to the medium M.

Second Embodiment

Figure 9:
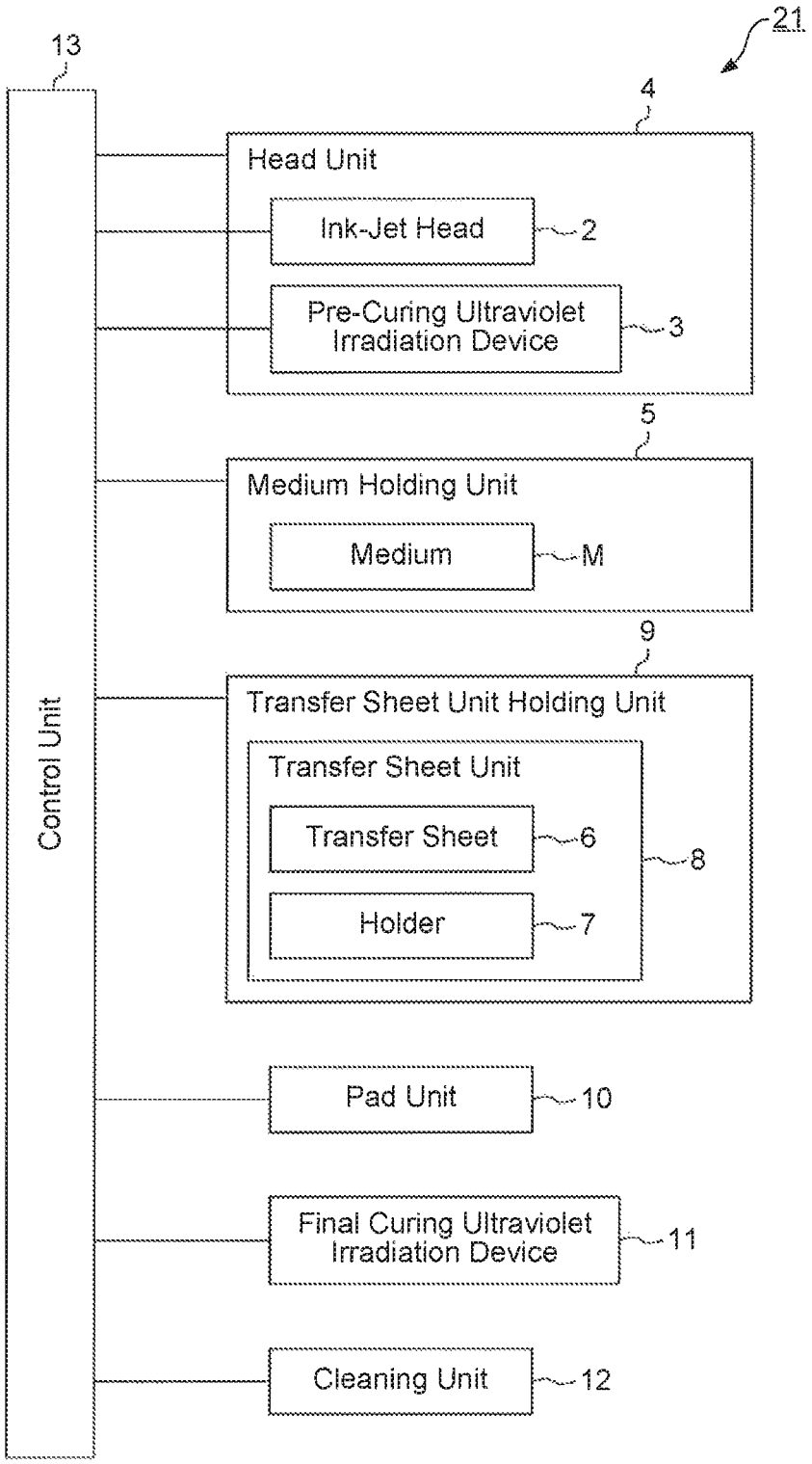
FIG. 9 A functional diagram of an ink-jet printer according to a second embodiment.
Figure 10:
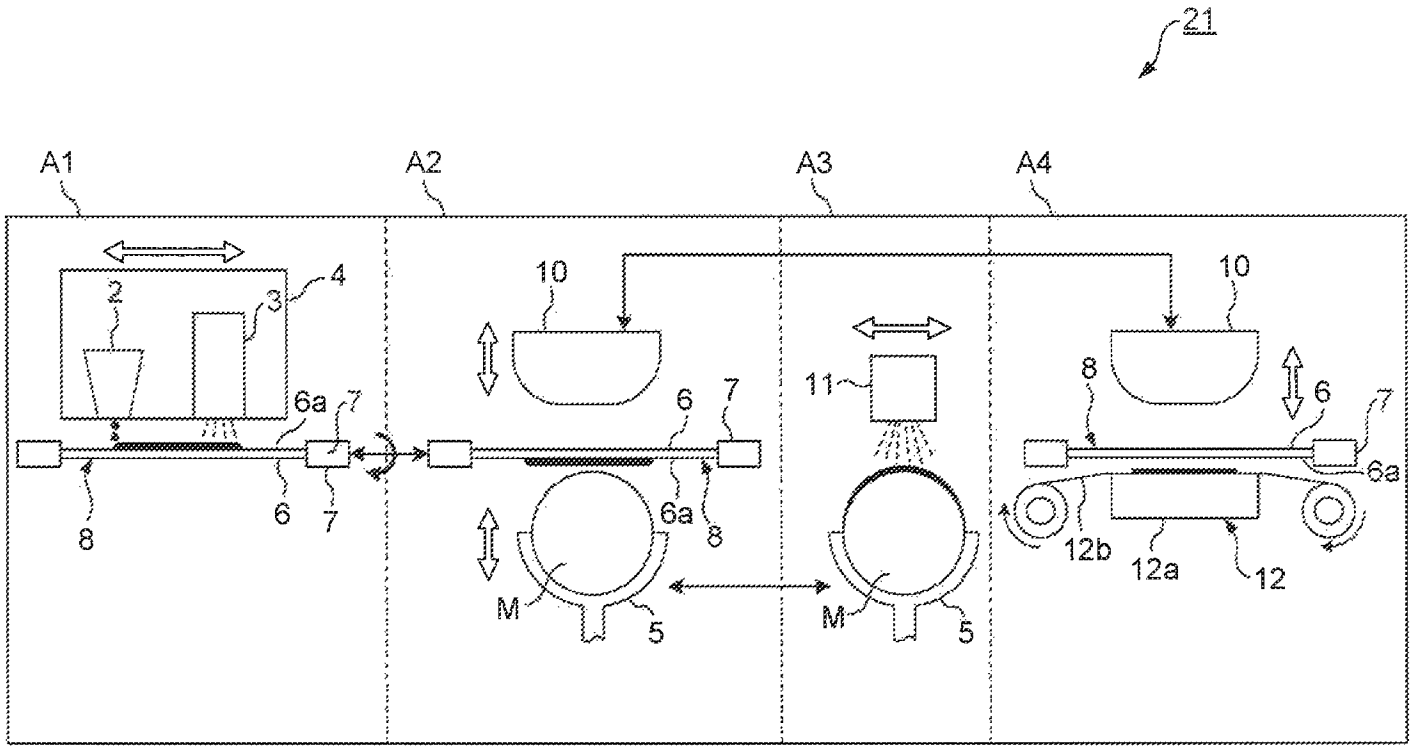
FIG. 10 A simplified drawing showing the arrangement of elements in the ink-jet printer from FIG. 9.

FIG. 9 is a functional diagram of an ink-jet printer according to a second embodiment. FIG. 10 is a simplified drawing showing the arrangement of elements in the ink jet printer from FIG. 9. As shown in FIG. 9 and FIG. 10, an ink-jet printer 21 is essentially similar to the first embodiment and is equipped with: the ink jet head 2; the pre-curing ultraviolet irradiation device 3; the head unit 4 in which is installed the ink jet head 2 and the pre-curing ultraviolet irradiation device 3; the medium holding unit 5 that holds the medium M; the transfer sheet unit holding unit 9 that holds the transfer sheet unit 8, in which the transfer sheet 6 is mounted to the transfer sheet holder 7; the pad unit 10; the final curing ultraviolet irradiation device 11; the cleaning unit 12; and the control unit 13.

As in the first embodiment, the ink-jet printer 21 is divided into the first area A1 to the fourth area A4. The head unit 4 is provided in the first area A1. The medium holding unit 5 is capable of moving between the second area A2 and the third area A3. The transfer sheet unit holding unit 9 is capable of moving between the first area A1, the second area A2, and the fourth area A4. The pad unit 10 is capable of moving between the second area A2 and the fourth area A4. The final curing ultraviolet irradiation device 11 is provided in the third area A3, and the cleaning unit 12 is provided in the fourth area A4.

The transfer sheet unit 8, which is held below the head unit 4 by the transfer sheet unit holding unit 9 is provided in the first area A1. In the second area A2, the medium M is held by the medium holding unit 5 below the transfer sheet unit 8 held by the transfer sheet unit holding unit 9, and the pad unit 10 is provided above the transfer sheet unit 8 held by the transfer sheet unit holding unit 9. In the third area A3, the final curing ultraviolet irradiation device 11 is provided above the medium M held by the medium holding unit 5. In the fourth area A4, the cleaning unit 12 is provided below the transfer sheet unit 8 held by the transfer sheet unit holding unit 9, and the pad unit 10 is provided above the transfer sheet unit 8 held by the transfer sheet unit holding unit 9. In other words, the ink-jet printer 21 according to the second embodiment differs from the ink-jet printer 1 according to the first embodiment in the placement of elements in the second area A2 to the fourth area A4.

The configuration of the ink-jet printer 21 will be described in detail.

The medium holding unit 5 holds the medium M from below and can move up and down. As a result, the medium holding unit 5 can be moved upward in the second area A2 to push the medium M against the transfer sheet 6. Rather than simply mounting the medium. M on the medium holding unit 5, it would be possible for the medium holding unit 5 to secure the medium M using suction or the like.

The transfer sheet unit holding unit 9 is basically similar to that of the first embodiment except that the transfer sheet unit 8 is held in a manner that allows the transfer sheet unit 8 to be reversed. The transfer sheet unit holding unit 9 orients the ink application surface 6*a* of the transfer sheet unit 8 upward in the first area A1, but then reverses the transfer sheet unit 8 when moving from the first area A1 to the second area A2 so that the ink application surface 6*a* is facing down. Also, the transfer sheet unit holding unit 9 reverses the transfer sheet unit 8 again when moving from the fourth area A4 to the first area A1 so that the ink application surface 6*a* is facing up.

The pad unit 10 is basically similar to that of the first embodiment except that by moving downward in the second area A2, the pad unit 10 applies pressure to deform the transfer sheet 6 and press it against the medium M held by the medium holding unit 5. Also, the pad unit 10 moves downward at the fourth area A4 so that the transfer sheet 6 is pressed against the cleaning unit 12.

The final curing ultraviolet irradiation device 11 is basically similar to that of the first embodiment but by emitting ultraviolet rays downward, the ultraviolet-curing ink transferred to the medium M can undergo final curing.

The cleaning unit 12 is basically similar to that of the first embodiment but by moving the pressing member 12*a* upward, the cleaning sheet 12*b* can be pressed against the transfer sheet 6.

Figure 11:
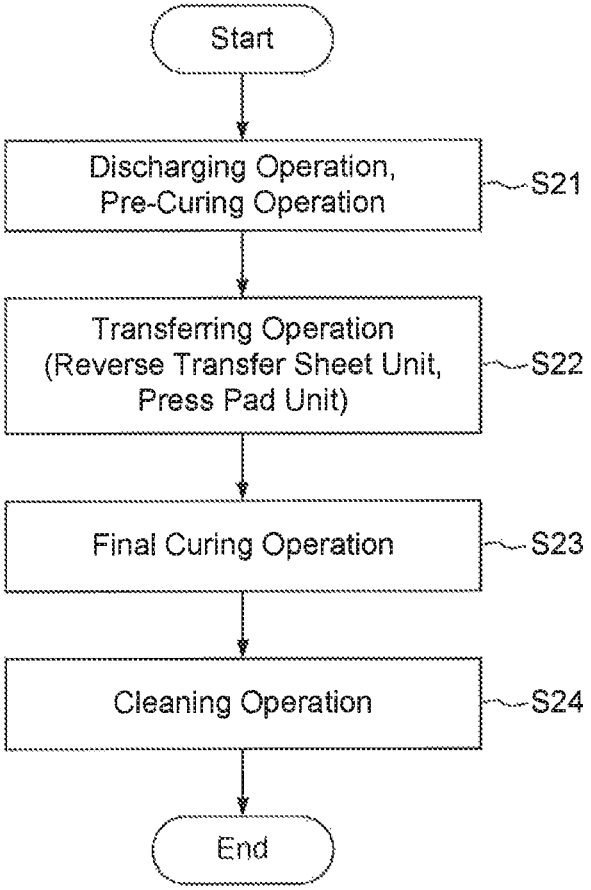
FIG. 11 A flowchart showing operations performed by the control unit.

Next, referring to FIG. 10, FIG. 11, FIG. 12A to FIG. 12C, and FIG. 13A to FIG. 13C, a method for performing transfer printing using the ink-jet printer 21 will be described. FIG. 11 is a flowchart showing operations performed by the control unit. FIG. 12A to FIG. 12C and FIG. 13A to FIG. 13C are drawings showing examples of operations performed by an ink-jet printer. The control unit 13 implements the operations described below with a processing unit (not shown in the drawings) formed from a CPU or the like that executes a computer program recorded in a storage device such as a ROM.

When performing transfer printing, the control unit 13 first heats the medium M and the transfer sheet 6.

Figure 12A:
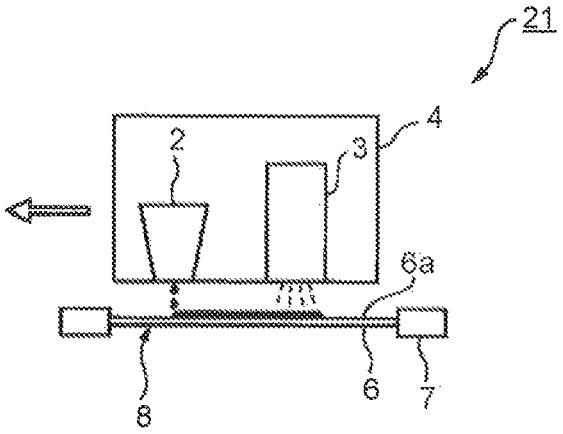
Figure 12B:
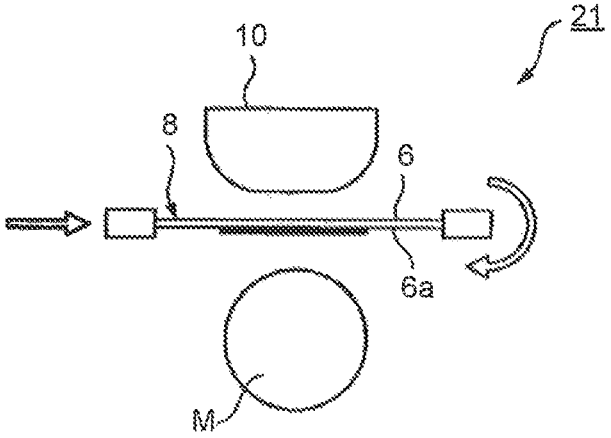

Next, the control unit 13 performs a discharging operation and a pre-curing operation to apply an ultraviolet-curing ink to the transfer sheet 6 and to pre-cure this applied ultraviolet-curing ink (step S21). More specifically, first, at step S21, the transfer sheet unit holding unit 9 is moved to the first area A1 and the transfer sheet unit 8 is positioned below the head unit 4 as shown in FIG. 10 and FIG. 12A. If the ink application surface 6*a* of the transfer sheet 6 is facing down, the transfer sheet unit 8 is reversed so that the ink application surface 6*a* is facing up. Then, the head unit 4 is moved in the scanning direction while the ultraviolet-curing ink is discharged from the ink-jet head 2 and ultraviolet rays are emitted from the pre-curing ultraviolet irradiation device 3. This causes the ultraviolet-curing ink discharged from the ink-jet head 2 to be applied to the transfer sheet 6, with the ultraviolet-curing ink applied to the transfer sheet 6 being exposed to the ultraviolet rays emitted from the pre-curing ultraviolet irradiation device 3. During this operation, the control unit 13 controls the movement velocity of the pre-curing ultraviolet irradiation device 3 and the intensity of the ultraviolet rays emitted by the pre-curing ultraviolet irradiation device 3 so that the ultraviolet-curing ink on the medium M is pre-cured and thickened to a viscosity in the range of 30 to 300 mPa·sec. As a result, the ultraviolet-curing ink applied to the transfer sheet 6 is thickened to a viscosity in the range of 30 to 300 mPa·sec at 25 deg C.

Next, the control unit 13 performs a transferring operation wherein the ultraviolet-curing ink applied to the transfer sheet 6 is transferred to the medium M (step S22). More specifically, first, at step S22, the medium holding unit 5, the transfer sheet unit holding unit 9, and the pad unit 10 are moved to the second area A2, and the transfer sheet unit 8 is reversed so that the ink application surface 6*a* of the transfer sheet 6 faces down as shown in FIG. 10 and FIG. 1.2B. Then, the medium M is positioned below the transfer sheet unit 8 and the pad unit 10 is positioned above the transfer sheet unit 8 so that the medium M and the pad unit 10 face each other, interposed by the transfer sheet unit 8.

Figure 12C:
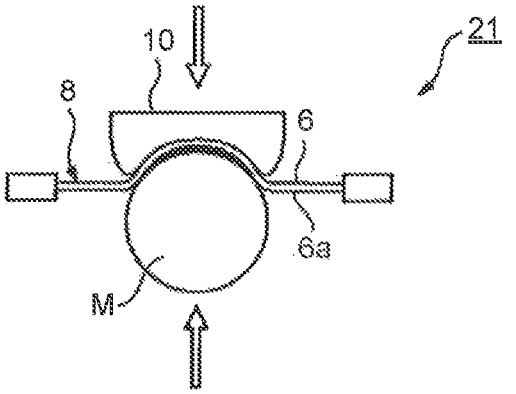

Then, when the medium M and the pad unit 10 face each other, interposed by the transfer sheet unit 8, the pad unit 10 is moved downward and the medium holding unit 5 is moved upward, as shown in FIG. 12C. The pad unit 10 is then pushed against the medium M with the transfer sheet 6 interposed, and the pad unit 10 and the transfer sheet 6 are deformed in the shape of the medium M. As a result, the elastic force of the pad unit 10 pushes the transfer sheet 6 against the medium M, with the ink application surface 6*a* thereof being pressed tightly against the medium M. At this time, the ultraviolet-curing ink is thickened but has not undergone final curing and is still a soft paste. As a result, the ultraviolet-curing ink is flattened by the transfer sheet 6 being pressed against the medium M.

Figure 13A:
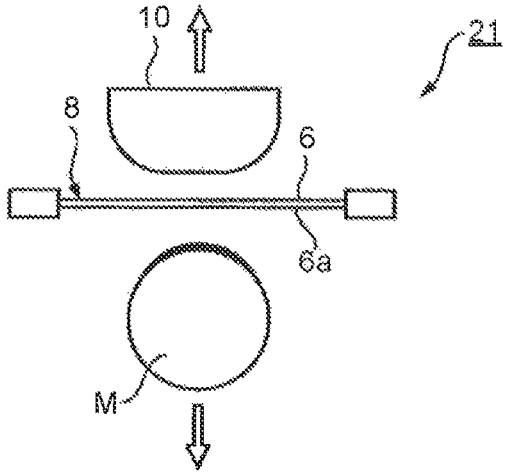

As shown in FIG. 13A, the pad unit 10 is then moved upward and returned to its original position and the medium holding unit 5 is moved downward and returned to its original position. As a result, the ultraviolet-curing ink applied to the transfer sheet 6 is transferred to the medium M. In this operation, the ultraviolet-curing ink, which is flattened by the pressing of the transfer sheet 6 against the medium M, is transferred to the medium M. As a result, a glossy image with a flattened surface is formed on the medium M.

Figure 13B:
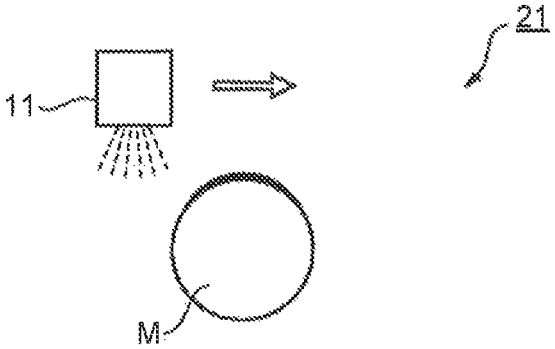

Next, the control unit 13 performs the final curing operation to subject the ultraviolet-curing ink transferred to the medium M to final curing (step S23). More specifically, first, at step S23, the medium holding unit 5 is moved to the third area A3 and the medium M is positioned below the final curing ultraviolet irradiation device 11 as shown in FIG. 10 and FIG. 13B.

Then, when the medium M is positioned below the final curing ultraviolet irradiation device 11, ultraviolet rays are emitted from the final curing ultraviolet irradiation device 11 while the final curing ultraviolet irradiation device 11 is moved in the scanning direction. During this operation, the control unit 13 controls the movement velocity of the final curing ultraviolet irradiation device 11 and the intensity of the ultraviolet rays emitted by the final curing ultraviolet irradiation device 11 so that the ultraviolet-curing ink on the medium M undergoes final curing. As a result, the ultraviolet-curing ink transferred to the medium M is exposed to ultraviolet rays, undergoes final curing, and is fused to the medium M.

Figure 13C:
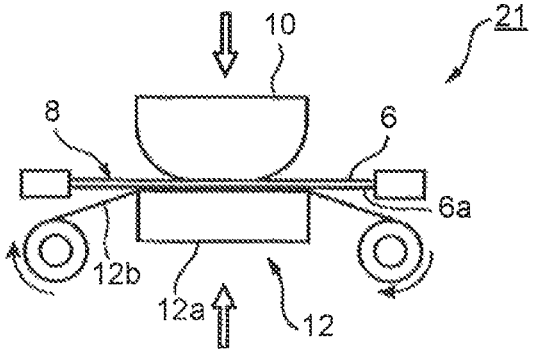

Next, the control unit 13 performs a cleaning operation to clean the transfer sheet 6 (step S24). More specifically, first, at step S24, the transfer sheet unit holding unit 9 and the pad unit 10 are moved to the fourth area A4 as shown in FIG. 10 and FIG. 13C. Then, the transfer sheet unit 8 is positioned above the cleaning unit 12 and the pad unit 10 is positioned above the transfer sheet unit 8 so that the cleaning unit 12 faces the pad unit 10 with the transfer sheet unit 8 being interposed therebetween.

With the cleaning unit 12 and the pad unit 10 facing each other and the transfer sheet unit 8 interposed therebetween, the pressing member 12*a* of the cleaning unit 12 is then moved upward, the pad unit 10 is moved downward, and the cleaning sheet 12*b* is driven. Then, the transfer sheet 6 and the cleaning sheet 12*b* are interposed between the pad unit 10 and the pressing member 12*a*, with the ink application surface of the transfer sheet 6 being rubbed by the cleaning sheet 12*b*. As a result, the cleaning sheet 12*b* wipes away debris adhesed to the transfer sheet 6 and residual ultraviolet-curing ink on the transfer sheet 6 that was not transferred to the medium M during the transfer operation at step S2.

Thus, in this embodiment, the transfer sheet unit holding unit 9 can reverse the transfer sheet unit 8 so that the ink application surface 6*a* can be made to face down after the ultraviolet-curing ink is applied to the transfer sheet 6. This makes it possible to transfer the ultraviolet-curing ink from the ink application surface 6*a* to the medium M by moving the medium M upward. As a result, a greater degree of freedom is provided for the design of the ink-jet printer 21. Furthermore, since the medium holding unit 5 simply needs to hold the medium M from below, the structure for holding the medium M can be simplified.

Third Embodiment

Figure 14:
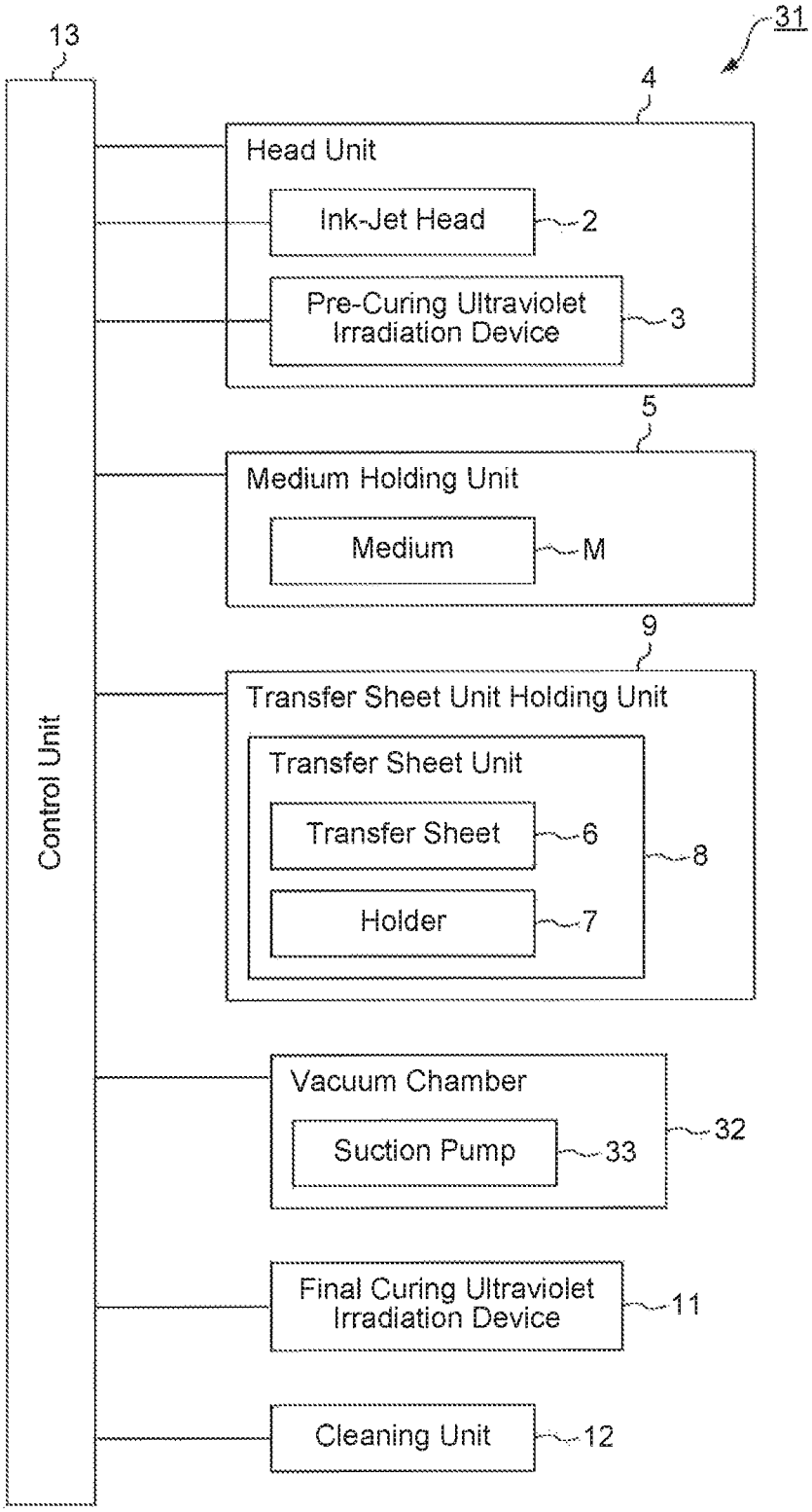
FIG. 14 A functional diagram of an ink-jet printer according to a third embodiment.
Figure 15:
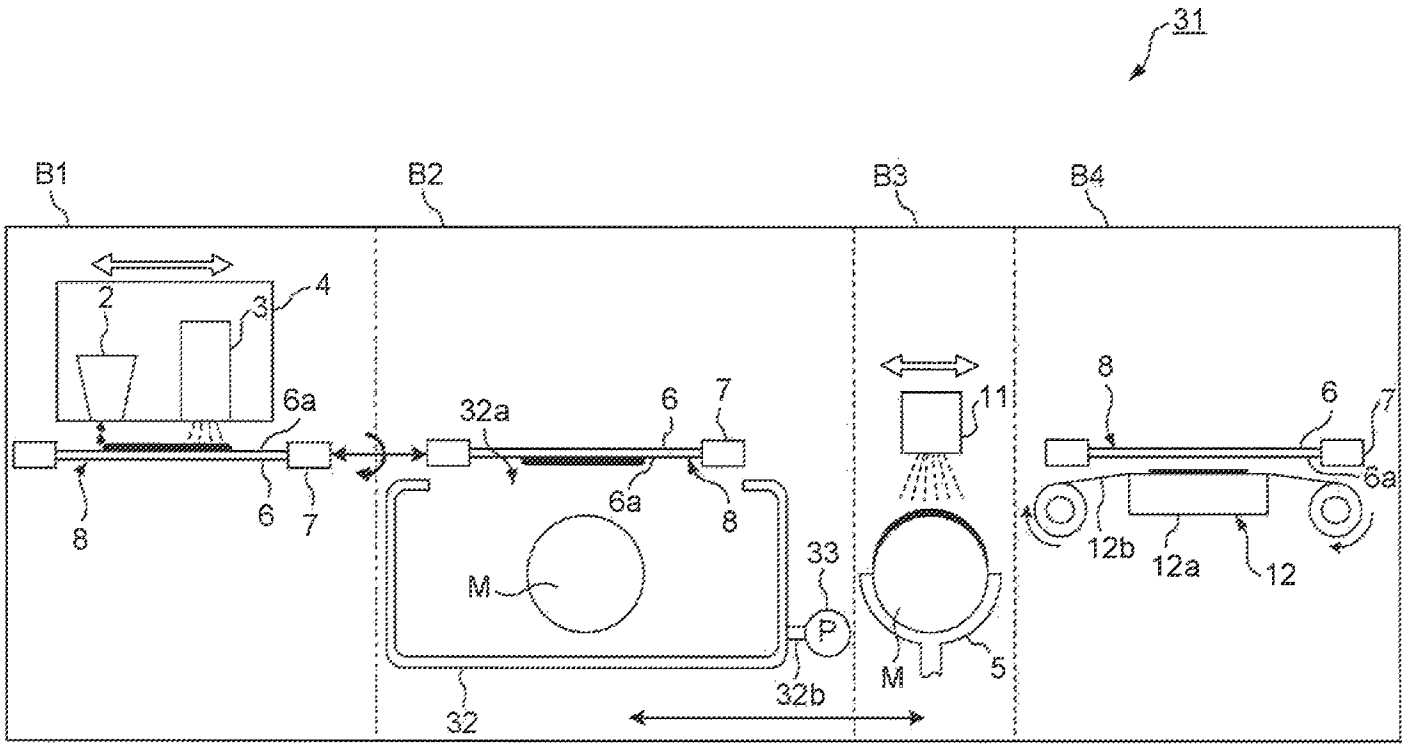
FIG. 15 A simplified drawing showing the arrangement of elements in the ink-jet printer from FIG. 14.

FIG. 14 is a functional diagram of an ink-jet printer according to a third embodiment. FIG. 15 is a simplified drawing showing the arrangement of elements in the ink-jet printer from FIG. 14. As shown in FIG. 14 and FIG. 15, an ink-jet printer 31 is basically similar to that of the second embodiment except that the pad unit 10 is replaced with a vacuum chamber 32 and a suction pump 33. More specifically, the ink-jet printer 31 is equipped with: the ink-jet head 2; the pre-curing ultraviolet irradiation device 3; the head unit 4 in which is installed the ink-jet head 2 and the pre-curing ultraviolet irradiation device 3; the medium holding unit 5 that holds the medium M; the transfer sheet unit holding unit 9 that holds the transfer sheet unit 8, in which the transfer sheet 6 is mounted to the transfer sheet holder 7; the vacuum chamber 32 that is connected to the suction pump 33; the final curing ultraviolet irradiation device 11; the cleaning unit 12; and the control unit 13.

The ink-jet printer 31 is divided into a first area B1 to a fourth area B4. In the first area B1, the ultraviolet-curing ink is applied to the transfer sheet 6 and the ultraviolet-curing ink that was applied to the transfer sheet 6 is pre-cured (thickened). In the second area B2, the ultraviolet-curing ink applied to the transfer sheet 6 is transferred to the medium M. In the third area B3, the ultraviolet-curing ink transferred to the medium M undergoes final curing and is fused to the medium M. In the fourth area B4, the transfer sheet 6 is cleaned.

This is achieved through the following configuration: the head unit 4 is provided in the first area B1; the medium holding unit 5 is capable of moving between the second area B2 and the third area B3; the transfer sheet unit holding unit 9 is capable of moving between the first area B1, the second area B2, and the fourth area B4; the vacuum chamber 32 and the suction pump 33 are provided in the second area B2; the final curing ultraviolet irradiation device 11 is provided in the third area B3; and the cleaning unit 12 is provided in the fourth area B4.

The transfer sheet unit 8, which is held below the head unit 4 by the transfer sheet unit holding unit 9 is provided in the first area B1. In the second area B2, the medium M is held by the medium holding unit 5 within the vacuum chamber 32, and the transfer sheet unit 8 held by the transfer sheet unit holding unit 9 is provided at an opening (described later) of the vacuum chamber 32. In the third area B3, the final curing ultraviolet irradiation device 11 is provided above the medium M held by the medium holding unit 5. In the fourth area B4, the cleaning unit 12 is provided below the transfer sheet unit 8 held by the transfer sheet unit holding unit 9. The separation between the first area B1 to the fourth area B4 can be either physical or functional.

The configuration of the ink-jet printer 31 will be described in detail.

The vacuum chamber 32 is a container into which the medium M is inserted, the upper section thereof being formed with an opening 32*a* and an intake opening 32.*b* that is connected to the suction pump 33. The opening 32*a* is formed larger than the outer dimensions of the medium M. Thus, the medium M can be inserted into the vacuum chamber 32 from the opening 32*a*. Also, the opening 32*a* can be tightly coupled with the transfer sheet holder 7 to form an air-tight seal. As a result, by tightly coupling the transfer sheet holder 7 and the opening 32*a* and covering the opening 32*a* with the transfer sheet unit 8, the vacuum chamber 32 can be kept air-tight.

The suction pump 33 is connected to the intake opening 32*b* of the vacuum chamber 32 and sucks out gas in the vacuum chamber 32 from the intake opening 32*b*. Thus, the suction pump 33 can decompress the vacuum chamber 32 by sucking out gas while the opening 32*a* of the vacuum chamber 32 is covered by the transfer sheet unit 8.

The medium holding unit 5 is basically similar to that of the second embodiment except that it is moved downward in the second area B2 to allow the medium M to be inserted into and removed from the vacuum chamber 32.

The transfer sheet unit holding unit 9 is basically similar to that of the second embodiment except that it is moved downward in the second area B2 to allow the transfer sheet unit 8 to seal the vacuum chamber 32 by tightly coupling the transfer sheet holder 7 with the opening of the vacuum chamber 32.

Figure 16:
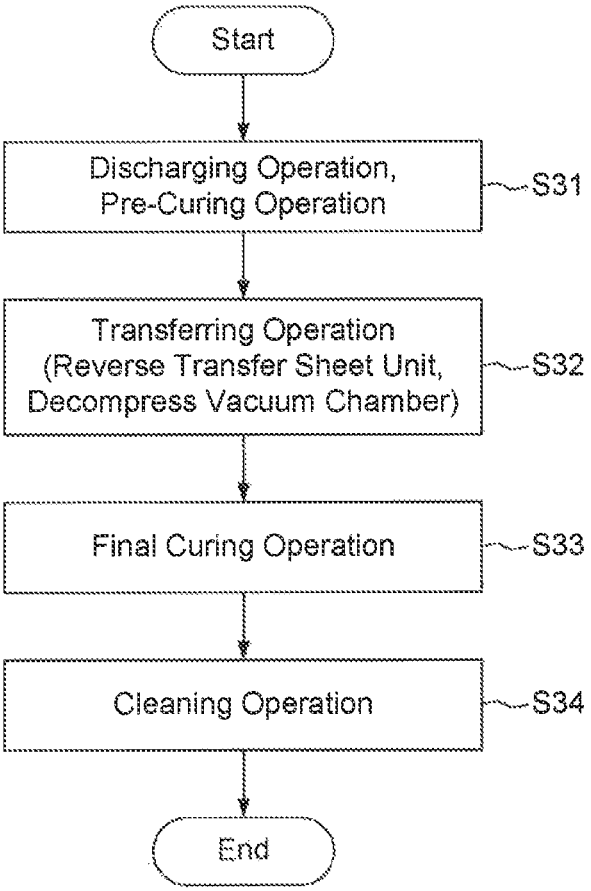
FIG. 16 A flowchart showing operations performed by the control unit.

Referring to FIG. 15, FIG. 16, FIG. 17A to FIG. 17C, and FIG. 18A to FIG. 18C, a transfer printing method that uses the ink-jet printer 31 will be described next. FIG. 16 is a flowchart showing operations performed by the control unit. FIG. 17A to FIG. 17C and FIG. 18A to FIG. 18C are drawings showing examples of operations performed by an ink jet printer. The control unit 13 implements the operations described below with a processing unit (not shown in the drawings) formed from a CPU or the like that executes a computer program recorded in a storage device such as a ROM.

When performing transfer printing, the control unit 13 first heats the medium M and the transfer sheet 6.

Figure 17A:
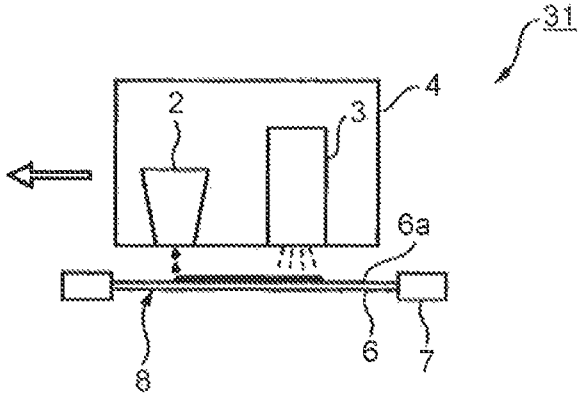

Next, the control unit 13 performs the discharging operation and the pre-curing operation to apply the ultraviolet-curing ink to the transfer sheet 6 and to pre-cure the applied ultraviolet-curing ink (step S31). More specifically, as shown in FIG. 15 and FIG. 17A, the transfer sheet unit holding unit 9 is moved to the first area B1 and the transfer sheet unit 8 is positioned below the head unit 4 at step S31. If the ink application surface 6*a* of the transfer sheet 6 is facing down, the transfer sheet unit 8 is reversed so that the ink application surface 6*a* is facing up. Then, while the head unit 4 is moved in the scanning direction, ultraviolet-curing ink is discharged from the ink-jet head 2 while ultraviolet rays are emitted from the pre-curing ultraviolet irradiation device 3. This causes the ultraviolet-curing ink discharged from the ink-jet head 2 to be applied to the transfer sheet 6, with the ultraviolet-curing ink applied to the transfer sheet 6 being exposed to the ultraviolet rays emitted from the pre-curing ultraviolet irradiation device 3. During this operation, the control unit 13 controls the movement velocity of the pre-curing ultraviolet irradiation device 3 and the intensity of the ultraviolet rays emitted by the pre-curing ultraviolet irradiation device 3 so that the ultraviolet-curing ink on the medium M is pre-cured and thickened to a viscosity in the range of 30 to 300 mPa·sec. As a result, the ultraviolet-curing ink applied to the transfer sheet 6 is thickened to a viscosity in the range of 30 to 300 mPa·sec at 25 deg C.

Figure 17B:
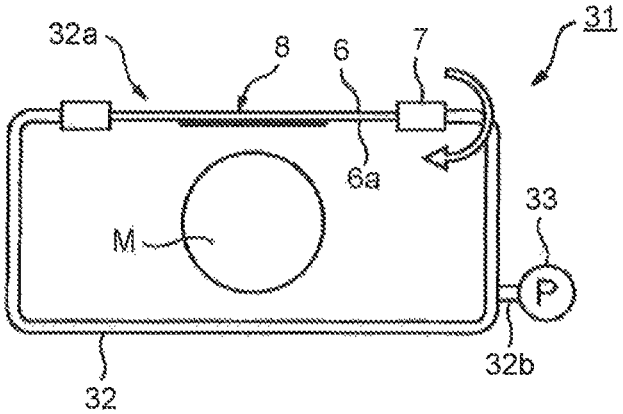

Next, the control unit 13 performs a transferring operation wherein the ultraviolet-curing ink applied to the transfer sheet 6 is transferred to the medium M (step S32). More specifically, first, at step S32, the medium holding unit 5 and the transfer sheet unit holding unit 9 are moved to the second area B2, and the transfer sheet unit 8 is reversed so that the ink application surface of the transfer sheet 6 faces down as shown in FIG. 15 and FIG. 17B. The medium M is then inserted into the vacuum chamber 32 through the opening 32*a*. Also, the transfer sheet holder 7 is tightly coupled to the opening 32*a*, and the opening 32*a* is covered with the transfer sheet unit 8 to seal the vacuum chamber 32. As a result, the medium M and the ink application surface 6*a* are facing each other inside of the sealed vacuum chamber 32.

Figure 17C:
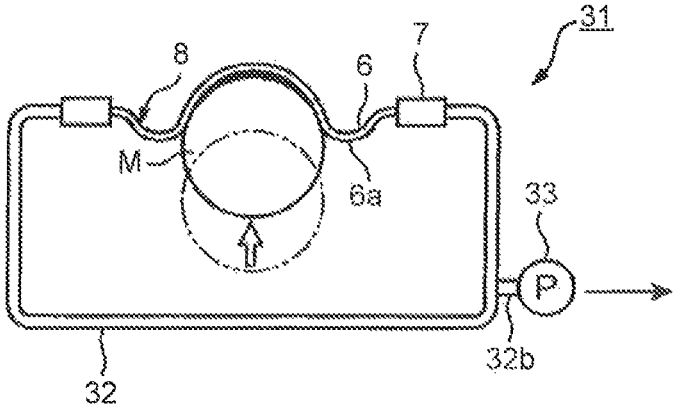

When the vacuum chamber 32 with the medium M inserted is sealed by the transfer sheet holder 7, as shown in FIG. 17C, the suction pump 33 is activated. The gas inside the vacuum chamber 32 is then sucked out from the intake opening 32*b* by the suction pump 33, decompressing the vacuum chamber 32. This causes the inside of the vacuum chamber 32 to have a negative pressure relative to atmospheric pressure. The pressure difference between the pressure inside the vacuum chamber 32 and atmospheric pressure results in the elastic deformation of the transfer sheet 6 toward the inside of the vacuum chamber 32, forming a tight contact with the medium M. The decompressed atmosphere inside the vacuum chamber 32 then causes the ink application surface 6*a* of the transfer sheet 6 to be pressed against the medium M. At this time, the ultraviolet-curing ink is thickened but has not undergone final curing and is still a soft paste. As a result, the ultraviolet-curing ink is flattened by the transfer sheet 6 being pressed against the medium M. It would also be possible to move the medium M upward when the vacuum is being formed in the vacuum chamber 32.

Figure 18A:
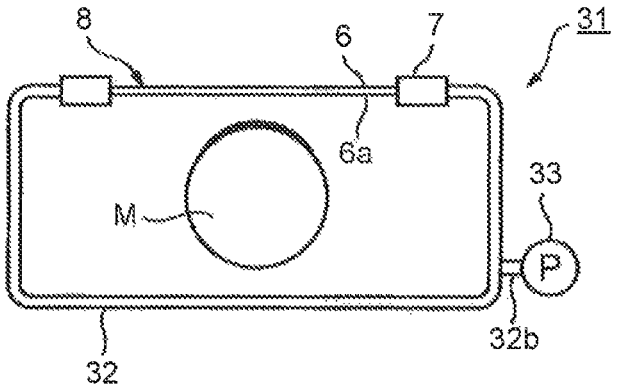

Then, as shown in FIG. 18A, the suction pump 33 is stopped and the inside of the vacuum chamber 32 is exposed to the atmosphere. This eliminates the pressure difference between the pressure inside the vacuum chamber 32 and atmospheric pressure, causing the transfer sheet 6 to be restored to its original, flat state. As a result, the ultraviolet-curing ink applied to the transfer sheet 6 is transferred to the medium M. In this operation, the ultraviolet-curing ink, which is flattened by the pressing of the transfer sheet 6 against the medium M, is transferred to the medium M. As a result, a glossy image with a flattened surface is formed on the medium M.

Figure 18B:
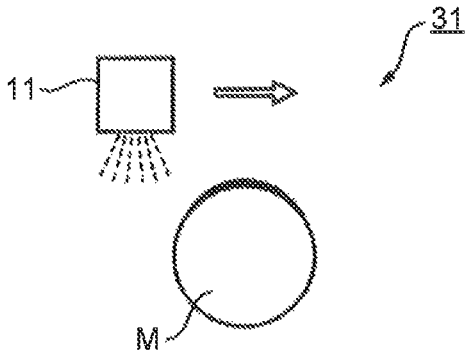

Next, the control unit 13 performs the final curing operation to subject the ultraviolet-curing ink transferred to the medium M to final curing (step S33). More specifically, first, at step S33, the medium holding unit 5 is moved to the third area B3 and the medium M is positioned below the final curing ultraviolet irradiation device 11 as shown in FIG. 15 and FIG. 18B.

Then, when the medium M is positioned below the final curing ultraviolet irradiation device 11, ultraviolet rays are emitted from the final curing ultraviolet irradiation device 11 while the final curing ultraviolet irradiation device 11 is moved in the scanning direction. During this operation, the control unit 13 controls the movement velocity of the final curing ultraviolet irradiation device 11 and the intensity of the ultraviolet rays emitted by the final curing ultraviolet irradiation device 11 so that the ultraviolet-curing ink on the medium M undergoes final curing. As a result, the ultraviolet-curing ink transferred to the medium M is exposed to ultraviolet rays, undergoes final curing, and is fused to the medium M.

Figure 18C:
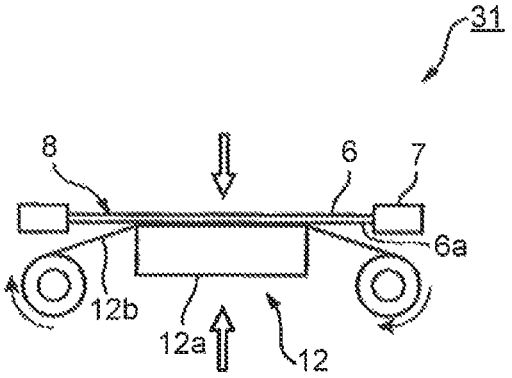

Next, the control unit 13 performs a cleaning operation to clean the transfer sheet 6 (step S34). More specifically, first, at step S34, the transfer sheet unit holding unit 9 is moved to the fourth area B4 and the transfer sheet unit 8 is positioned above the cleaning unit 12 as shown in FIG. 15 and FIG. 18C.

The pressing member 12*a* of the cleaning unit 12 is then moved upward and the cleaning sheet 12*b* is driven. This causes the ink application surface of the transfer sheet 6 to be rubbed by the cleaning sheet 12*b*. As a result, the cleaning sheet 12*b* wipes away debris adhesed to the transfer sheet 6 and residual ultraviolet-curing ink on the transfer sheet 6 that was not transferred to the medium M during the transfer operation at step S2. It would also be possible, at step S34, to improve cleaning performance by providing an elastic member (not shown in the drawing) opposite from the transfer sheet 6 on the other side of the cleaning unit 12 so that the transfer sheet 6 and the cleaning sheet 12*b* are interposed between the elastic member and the pressing member 12*a*.

In this embodiment, as described above, the medium M is inserted into the vacuum chamber 32, the opening 32*a* is covered by the transfer sheet unit 8, and the vacuum chamber 32 is decompressed using the suction pump 33. As a result, the transfer sheet 6 is sucked in toward the vacuum chamber 32 and the ink application surface 6*a* is pressed tightly against the surface of the medium M, thus allowing the ultraviolet-curing ink applied to the transfer sheet 6 to be transferred to the medium M.

Fourth Embodiment

Figure 19:
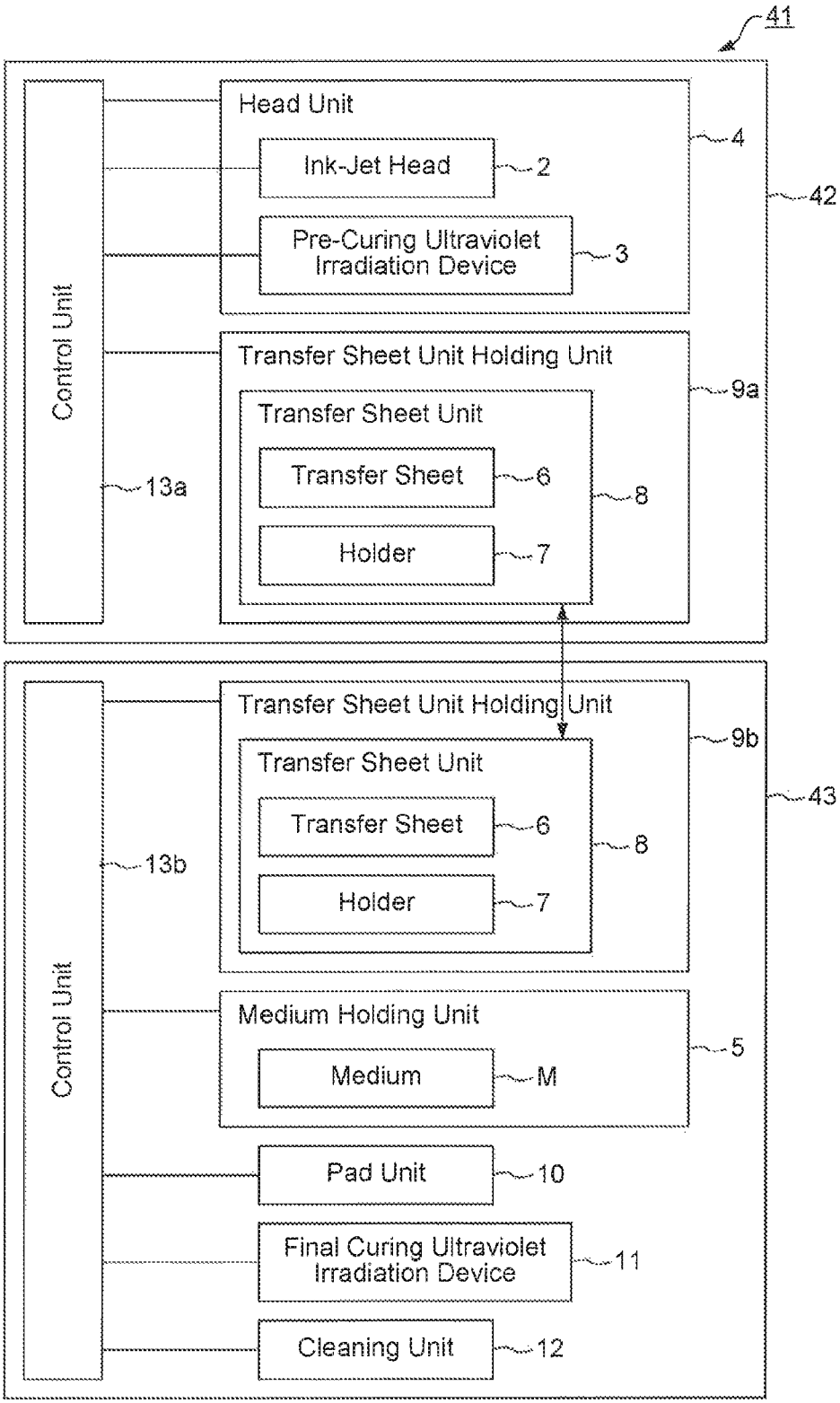
FIG. 19 A functional diagram of an ink-jet printer system according to a fourth embodiment.
Figure 20:
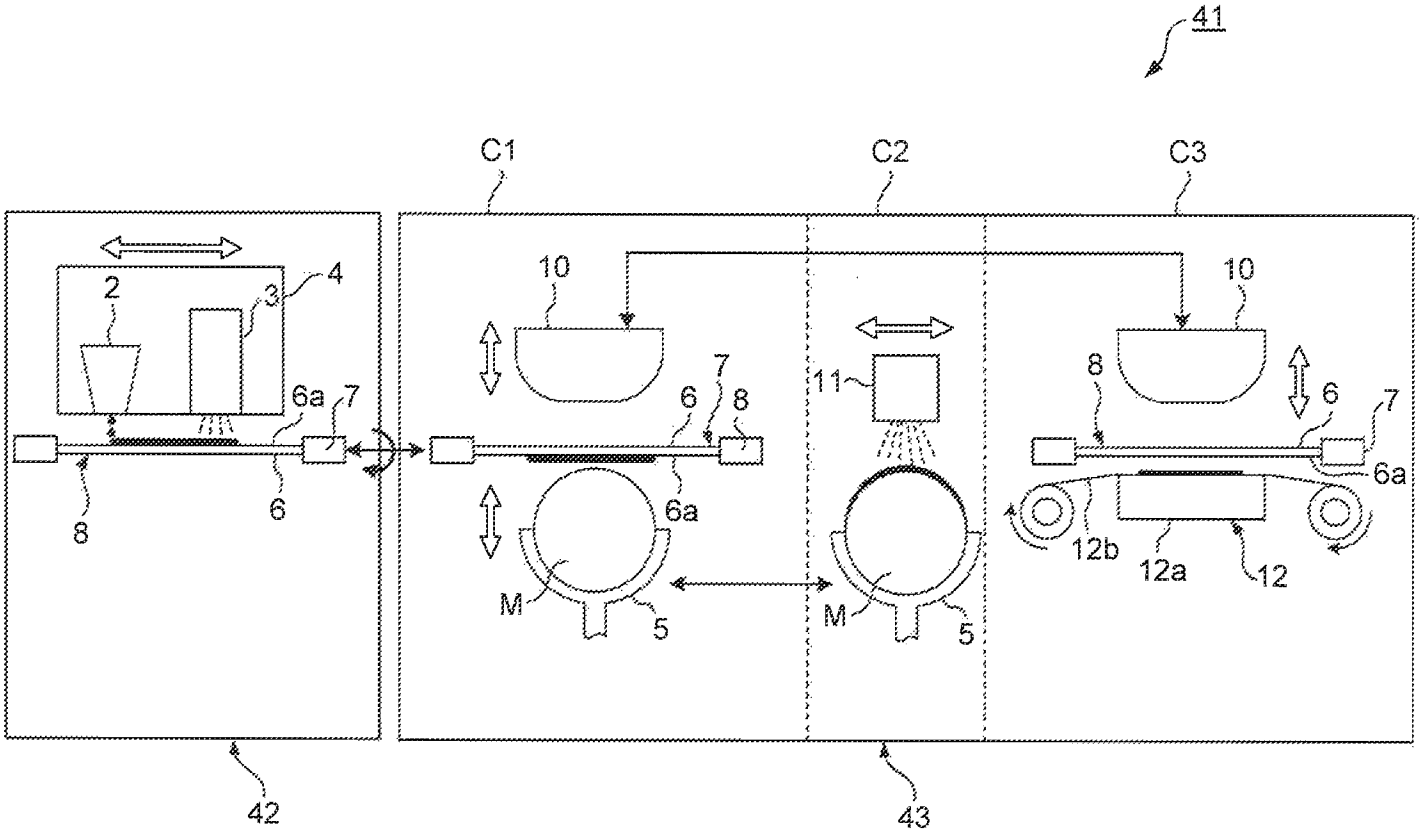
FIG. 20 A simplified drawing showing the arrangement of elements in the ink-jet printer system from FIG. 19.

FIG. 19 is a functional diagram of an ink-jet printer system according to a fourth embodiment. FIG. 20 is a simplified drawing showing the arrangement of elements in the ink-jet printer system from FIG. 19. As shown in FIG. 19 and FIG. 20, in the fourth embodiment, the image forming device according to the present invention is used in an ink-jet printer system 41 formed from an ink-jet printer 42 and a transfer device 43.

The ink-jet printer 42 is equipped with: the ink-jet head 2; the pre-curing ultraviolet irradiation device 3; the head unit 4 in which is installed the ink-jet head 2 and the pre-curing ultraviolet irradiation device 3; a transfer sheet unit holding unit 9*a* that holds the transfer sheet unit 8, in which the transfer sheet 6 is mounted to the transfer sheet holder 7; and a control unit 13*a*.

In the ink-jet printer 42, the ultraviolet-curing ink is discharged from the ink-jet head 2 and ultraviolet rays are emitted on to the ultraviolet-curing ink applied to the transfer sheet 6. As in the first embodiment, the ink jet printer 21 provides a configuration wherein ultraviolet-curing ink is discharged from the ink jet head 2, the ultraviolet-curing ink is applied to the transfer sheet 6, the pre-curing ultraviolet irradiation device 3 emits ultraviolet rays, and the ultraviolet-curing ink applied to the transfer sheet is pre-cured (thickened). Thus, in the ink-jet printer 42, the transfer sheet unit 8 held by the transfer sheet unit holding unit 9*a* is positioned below the head unit 4.

In the ink-jet printer 42, the transfer sheet unit holding unit 9*a* holds the transfer sheet unit 8 in a removable manner. As a result, with the ink-jet printer 42, the ultraviolet-curing ink is applied and pre-cured on the transfer sheet 6, which can then be removed from the transfer sheet unit holding unit 9*a* and conveyed to the transfer device 43. The transfer sheet unit 8 can be conveyed from the ink-jet printer 42 to the transfer device 43 by an operator or by a conveyor device not shown in the drawings.

The transfer device 43 is equipped with: a transfer sheet unit holding unit 9*b* that holds a transfer sheet unit 8, in which a transfer sheet 6 is mounted to a transfer sheet holder 7; the medium holding unit 5 that holds the medium M; the pad unit 10; the final curing ultraviolet irradiation device 11; the cleaning unit 12; and a control unit 13*b*.

The transfer device 43 receives the transfer sheet unit 8 conveyed from the ink-jet printer 42 and transfers the ultraviolet-curing ink applied to the transfer sheet 6 to the medium M. To achieve this, the transfer device 43 is divided into three regions, a first area C1 to a third area C3. In the first area C1, the ultraviolet-curing ink applied to the transfer sheet 6 is transferred to the medium M. In the second area C2, the ultraviolet-curing ink transferred to the medium M undergoes final curing and is fused to the medium M. In the third area C3, the transfer sheet 6 is cleaned.

This is achieved through the following configuration: the medium holding unit 5 is capable of moving between the first area C1 and the second area C2; the transfer sheet unit holding unit 9*b* is capable of moving between the first area C1 and the third area C3; the pad unit 10 is capable of moving between the first area C1 and the third area C3, the final curing ultraviolet irradiation device 11 is provided in the second area C2; and the cleaning unit 12 is provided in the third area C3. The separation between the first area C1 to the third area C3 can be either physical or functional.

In the first area C1, the medium M is held by the medium holding unit 5 below the transfer sheet unit 8 held by the transfer sheet unit holding unit 9*b*, and the pad unit 10 is provided above the transfer sheet unit 8 held by the transfer sheet unit holding unit 9*b*. In the second area C2, the final curing ultraviolet irradiation device 11 is provided above the medium M held by the medium holding unit 5. In the third area C3, the cleaning unit 12 is provided below the transfer sheet unit 8 held by the transfer sheet unit holding unit 9*b*, and the pad unit 10 is provided above the transfer sheet unit 8 held by the transfer sheet unit holding unit 9*b*. The separation between the first area C1 to the third area C3 can be either physical or functional.

In the transfer device 43, the transfer sheet unit holding unit 9*b* holds the transfer sheet unit 8 in a removable manner. Thus, the transfer sheet unit holding unit 9*b* is able to hold the transfer sheet unit 8 conveyed from the ink-jet printer 42. The transfer sheet unit holding unit 9*b* then holds, facing down, the ink application surface 6*a* of the transfer sheet 6 on which is applied the ultraviolet-curing ink.

Figure 21:
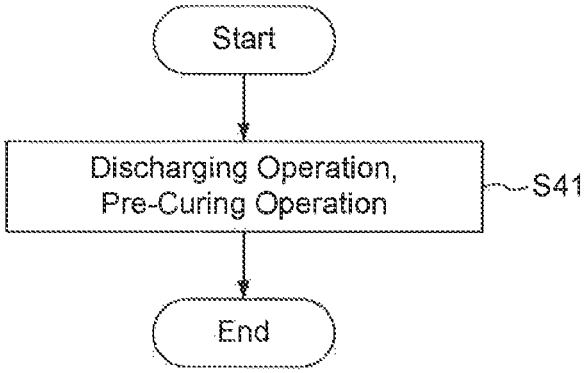
FIG. 21 A flowchart showing operations performed by the control unit of the ink-jet printer.
Figure 22:
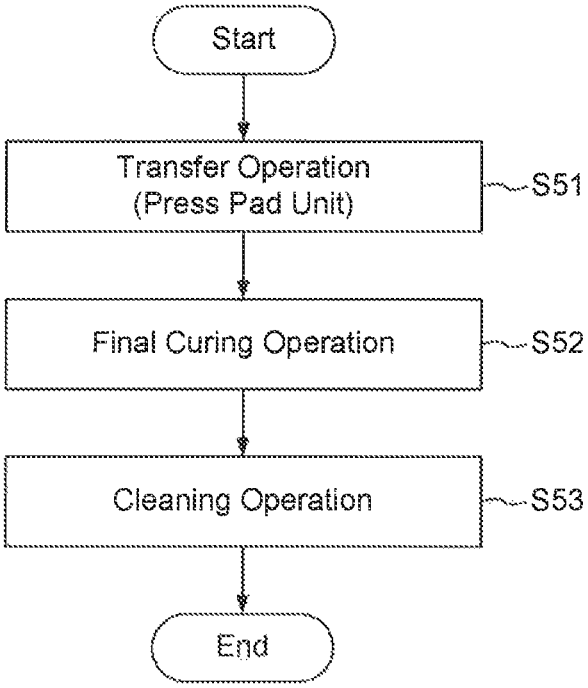
FIG. 22 A flowchart showing the operations performed by the control unit for the transfer device.

Next, referring to FIG. 20, FIG. 21, FIG. 22, FIG. 23A to FIG. 23C, and FIG. 24A to FIG. 24C, a transfer printing method using the ink-jet printer system 41 will be described. FIG. 21 is a flowchart showing operations performed by the control unit of the ink-jet printer. FIG. 22 is a flowchart showing the operations performed by the control unit for the transfer device. FIG. 23A to FIG. 23C and FIG. 24A to FIG. 24C are drawings showing examples of operations performed by an ink-jet printer. The control unit 13*a* and the control unit 13*b* implement the operations described below with a processing unit (not shown in the drawings) formed from a CPU or the like that executes a computer program recorded in a storage device such as a ROM.

First, the transfer sheet unit 8 is mounted to the transfer sheet unit holding unit 9*a* of the ink-jet printer 42. This is done with the ink application surface 6*a* of the transfer sheet 6 facing up.

Figure 23A:
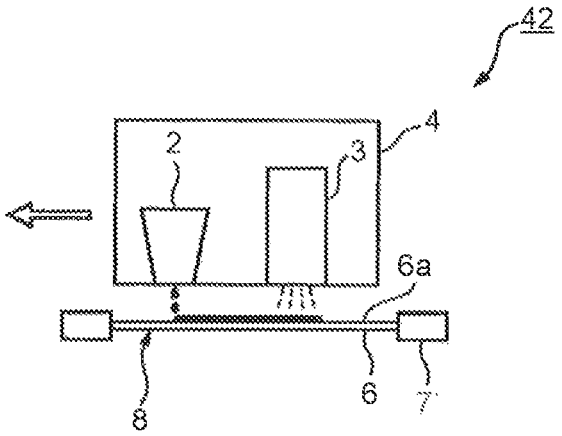

Next, the control unit 13*a* of the ink-jet printer 42 performs the discharging operation and the pre-curing operation to apply the ultraviolet-curing ink to the transfer sheet 6 and to pre-cure the applied ultraviolet-curing ink (step S41). More specifically, first, at step S41, while the head unit 4 is moved in the scanning direction, ultraviolet-curing ink is discharged from the ink-jet head 2 and ultraviolet rays are emitted from the pre-curing ultraviolet irradiation device 3 as shown in FIG. 20 and FIG. 23A. This causes the ultraviolet-curing ink discharged from the ink-jet head 2 to be applied to the transfer sheet 6, with the ultraviolet-curing ink applied to the transfer sheet 6 being exposed to the ultraviolet rays emitted from the pre-curing ultraviolet irradiation device 3. During this operation, the control unit 13 controls the movement velocity of the pre-curing ultraviolet irradiation device 3 and the intensity of the ultraviolet rays emitted by the pre-curing ultraviolet irradiation device 3 so that the ultraviolet-curing ink on the medium M is pre-cured and thickened to a viscosity in the range of 30 to 300 mPa·sec. As a result, the ultraviolet-curing ink applied to the transfer sheet 6 is thickened to a viscosity in the range of 30 to 300 mPa·sec at 25 deg C.

When the ink has been applied to the transfer sheet 6, the transfer sheet unit 8 is removed from the transfer sheet unit holding unit 9*a* and transported to the transfer device 43. The transfer sheet unit 8 is then mounted on the transfer sheet unit holding unit 9*b* of the transfer device 43. This is done with the ink application surface 6*a* of the transfer sheet 6 facing down.

The control unit 13*b* of the transfer device 43 then heats the medium M and the transfer sheet 6.

Figure 23B:
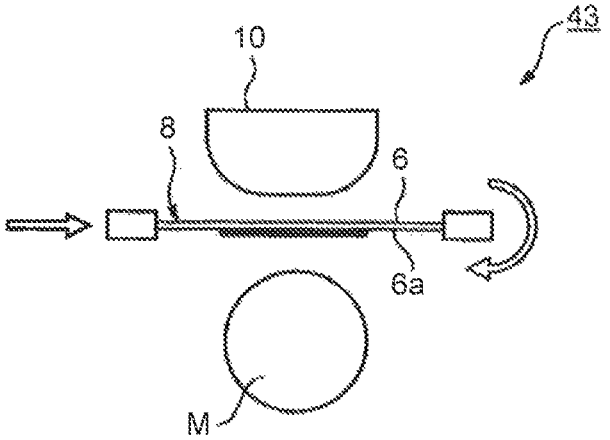

Next, the control unit 13*b* performs a transferring operation wherein the ultraviolet-curing ink applied to the transfer sheet 6 is transferred to the medium M (step S51). More specifically, first, at step S51, the medium holding unit 5, the transfer sheet unit holding unit 9*b*, and the pad unit 10 are moved to the first area C1 at step S51 as shown in FIG. 20 and FIG. 23B. Then, the medium M is positioned below the transfer sheet unit 8 and the pad unit 10 is positioned above the transfer sheet unit 8 so that the medium M and the pad unit 10 face each other, interposed by the transfer sheet unit 8.

Figure 23C:
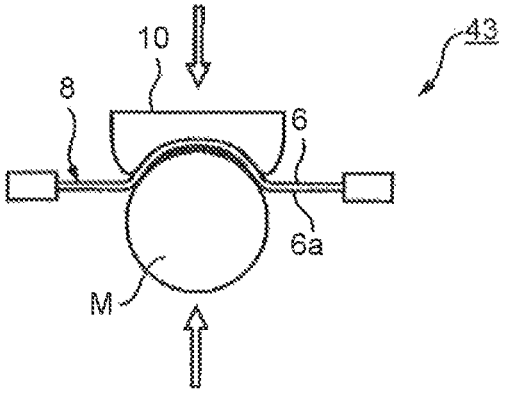

With the medium M and the pad unit 10 facing each other, interposed by the transfer sheet unit 8, the pad unit 10 is moved downward and the medium holding unit 5 is moved upward, as shown in FIG. 23C. The pad unit 10 is pressed against the medium M with the transfer sheet 6 interposed. The pad unit 10 and the transfer sheet 6 are deformed in the shape of the medium M. As a result, the elastic force of the pad unit 10 causes medium M to push against the transfer sheet 6, with the ink application surface 6*a* being pressed tightly against the medium M. At this time, the ultraviolet-curing ink is thickened but has not undergone final curing and is still a soft paste. As a result, the ultraviolet-curing ink is flattened by the transfer sheet 6 being pressed against the medium M.

Figure 24A:
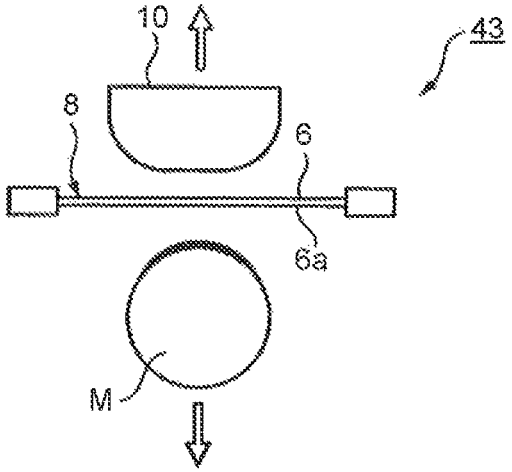

As shown in FIG. 24A, the pad unit 10 is then moved upward and returned to its original position and the medium holding unit 5 is moved downward and returned to its original position. As a result, the ultraviolet-curing ink applied to the transfer sheet 6 is transferred to the medium M. In this operation, the ultraviolet-curing ink, which is flattened by the pressing of the transfer sheet 6 against the medium M, is transferred to the medium M. As a result, a glossy image with a flattened surface is formed on the medium M.

Figure 24B:
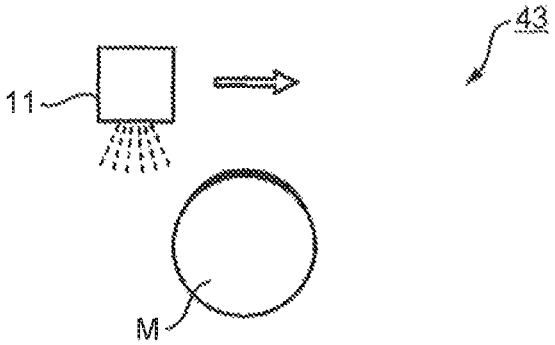

Next, the control unit 13*b* performs the final curing operation to subject the ultraviolet-curing ink transferred to the medium M to final curing (step S52). More specifically, first, at step S52, the medium holding unit 5 is moved to the second area C2 and the medium M is positioned below the final curing ultraviolet irradiation device 11 as shown in FIG. 20 and FIG. 24B.

Then, when the medium M is positioned below the final curing ultraviolet irradiation device 11, ultraviolet rays are emitted from the final curing ultraviolet irradiation device 11 while the final curing ultraviolet irradiation device 11 is moved in the scanning direction. During this operation, the control unit 13 controls the movement velocity of the final curing ultraviolet irradiation device 11 and the intensity of the ultraviolet rays emitted by the final curing ultraviolet irradiation device 11 so that the ultraviolet-curing ink on the medium M undergoes final curing. As a result, the ultraviolet-curing ink transferred to the medium M is exposed to ultraviolet rays, undergoes final curing, and is fused to the medium M.

Figure 24C:
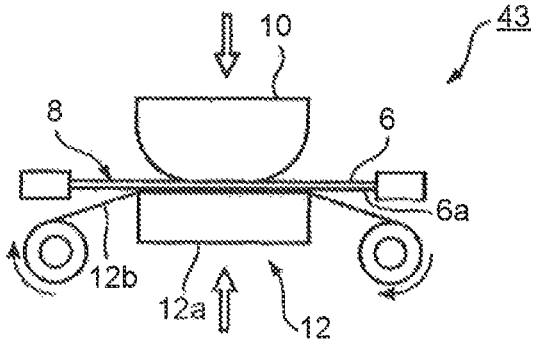

Next, the control unit 13*b* performs a cleaning operation to clean the transfer sheet 6 (step S53). More specifically, first, at step S53, the transfer sheet unit holding unit 9*b* and the pad unit 10 are moved to the third area C3 as shown in FIG. 20 and FIG. 24C. Then, the transfer sheet unit 8 is positioned above the cleaning unit 12 and the pad unit 10 is positioned above the transfer sheet unit 8 so that the cleaning unit 12 faces the pad unit 10 with the transfer sheet unit 8 being interposed therebetween.

With the cleaning unit 12 and the pad unit 10 facing each other and the transfer sheet unit 8 interposed therebetween, the pressing member 12*a* of the cleaning unit 12 is then moved upward, the pad unit 10 is moved downward, and the cleaning sheet 12*b* is driven. Then, the transfer sheet 6 and the cleaning sheet 12*b* are interposed between the pad unit 10 and the pressing member 12*a*, with the ink application surface of the transfer sheet 6 being rubbed by the cleaning sheet 12*b*. As a result, the cleaning sheet 12*b* wipes away debris adhesed to the transfer sheet 6 and residual ultraviolet-curing ink on the transfer sheet 6 that was not transferred to the medium M during the transfer operation at step S2.

Thus, in this embodiment, the device that applies the ultraviolet-curing ink to the transfer sheet 6 is separate from the device that transfers the ultraviolet-curing ink applied to the transfer sheet 6 to the medium M. This makes it possible to provide a greater degree of design and combination freedom. For example, the invention of the present application can be achieved using an existing ink-jet printer.

Figure 25A:
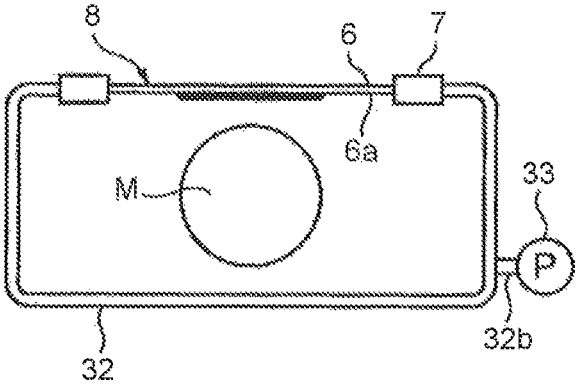
FIG. 25A to FIG. 25C are drawings showing alternative examples of operations performed by the third embodiment.
Figure 25B:
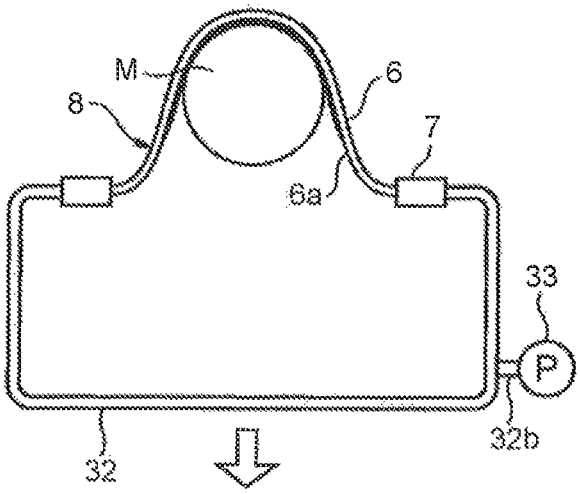
Figure 25C:
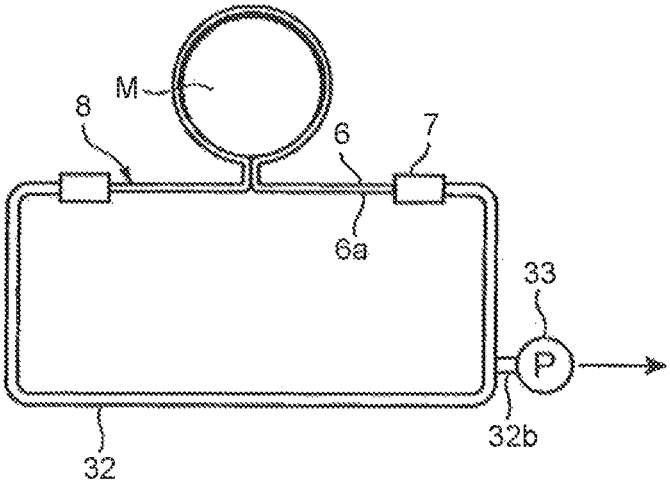

The preferred embodiments of the present invention are described above, but the present invention is not restricted to these embodiments. Referring to FIG. 25A to FIG. 25C, for example, it would be possible in the transfer step (step S32) from the third embodiment, to move the vacuum chamber 32 and/or the medium M after inserting the medium M in the vacuum chamber 32 and covering the opening 32*a* with the transfer sheet unit 8. More specifically, first, as shown in FIG. 23A, the medium M is inserted into the vacuum chamber 32 and the opening 32*a* is covered with the transfer sheet unit 8. Next, as shown in FIG. 23B, the vacuum chamber 32 and the transfer sheet holder 7 are moved downward so that the transfer sheet holder 7 is moved below the medium M. The transfer sheet holder 7 does not necessarily need to be moved below the medium M, and it would be acceptable to simply move the transfer sheet holder 7 to an appropriate position. Next, as shown in FIG. 23C, the suction pump 33 is used to decompress the vacuum chamber 32 and suck in the transfer sheet 6. As a result, the area over which the transfer sheet 6 forms a tight contact with the medium M is increased, thus allowing an image to be formed on the side surfaces, the top surface, the bottom surface, and the like of the medium M.

The embodiments above did not specifically indicate the type of LED used in the pre-curing ultraviolet irradiation device 3 and the final curing ultraviolet irradiation device 11. Any type of LED can be used. For example, when using LEDs with suitably high output, LEDs that emit near-ultraviolet rays and LEDs that emit blue, green, or white visible light can be used. Also, instead of LEDs, it would be possible to use metal-halide lamps, xenon lamps, and the like if ultraviolet rays with short wavelengths are blocked. It would also be possible to use a black light that emits UV-C light.

Also, in the embodiments above, the transfer sheet 6 is described as being formed with silicone rubber. However, any material can be used as long as it has elasticity and is capable of transferring ultraviolet-curing, ink. Examples include any of the following materials, used singly or in combination as a composite material, selected according to purpose: rubbers such as fluoro rubber, butyl rubber, chloroprene rubber, urethane rubber, butadiene rubber, neoprene (a registered trademark of DuPont), and EPDM; various types of elastomers; and various types of resins. If the transfer sheet 6 is to be disposable, the material does not have to be a material like rubber that returns to its original shape when pressure is removed. For example, a thin thermoplastic film such as a laminate film can be used. Also, the hardness and thickness of the transfer sheet 6 can be varied according to the shape of the medium M. For more complex media shapes, the hardness and thickness can be reduced. If the medium M is substantially flat, the transfer sheet 6 can be formed as a thick rubber plate rather than as a thin sheet.

Furthermore, in the embodiments above, the transfer sheet holder 7 holding the transfer sheet 6 is described as being shaped like a ring. However, the frame that holds the transfer sheet can have any shape. For example, a polygonal ring shape, e.g., a square shape, can be used. If the frame is to be formed as a polygonal ring, it would be preferable to include tension adjusting means to adjust the tension acting on the transfer sheet. For example, this tension adjust means can be configured so that at least one side of the frame is movable, with the tension on the transfer sheet being adjusted by moving this side. Alternatively, the tension on the transfer sheet can be adjusted by moving a jig that holds the frame. This prevents distortions in the image transferred to the medium even when using a frame shaped as a polygonal ring.

The pad unit 10 can be formed in any shape or from any material as long as there is elasticity. As described above, since the pad unit 10 does not come into direct contact with the ultraviolet-curing ink, it simply needs to apply uniform pressure to the medium M. Thus, instead of soft rubber, it would be possible to use hard rubber, a sponge material, or a bag-shaped member containing a liquid, powder, or gas. Also, if the medium M is substantially flat and a thick transfer sheet 6 can be used, materials such as metal, resin, wood, felt, and the like can be used for the pad unit 10.

Also, in the first, the second, and the third embodiments, a tight contact is formed between the transfer sheet 6 and the medium M by moving the pad unit 10. However, it would be possible to form a tight contact between the transfer sheet 6 and the medium M by inflating a bag-shaped member. For example, an elastic bag-shaped member like a balloon can be placed opposite from the transfer sheet 6 on the other side of the medium M, and inflating means such as a pump can be provided to inflate the bag-shaped member. With this configuration, when the bag-shaped structure is inflated by inflating means, the inflated bag-shaped member can push the transfer sheet 6 against the medium M, with the bag-shaped member and the transfer sheet 6 being deformed according to the shape of the medium M. This causes the transfer sheet 6 to be pressed tightly against the medium M, allowing the ink applied to the transfer sheet 6 to be transferred to the medium M. It would be preferable to form the bag-shaped member from a material that expands no more than a fixed amount and to select transfer pressure and hardness on the basis of the magnitude of the air pressure. With this configuration, the transfer sheet 6 can be pressed against the medium M with a uniform pressure. Furthermore, in this configuration, it would be possible to partition the inside of the bag-shaped member into a plurality of chambers with the air pressure being varied for each chamber. As a result, images can be transferred in an appropriate manner to differently shaped media M.

In the embodiments described above, an ultraviolet-curing ink is used. However, any ink can be used as long as it can be applied to the transfer sheet 6 and can be transferred from the transfer sheet 6 to the medium M. For example, it would be possible to use a thermosetting ink, e.g., an electron beam curing ink or a latex ink, a heat-drying ink, e.g., a solvent ink, or the like. As long as the ink can be thickened on the transfer sheet 6, it would also be possible to use a thermosetting ink or an aqueous latex ink or solvent ink with a solvent that evaporates in heat. In such cases, the thickening, curing, and fusing can be performed by heating or drying the ink.

Also, the embodiments above described an image being formed on a spherical medium M. However, the medium M can have any shape and can be formed from any material. In particular, by thickening the ink on the transfer sheet 6, a good image can be formed even in a medium formed from a material that can easily absorb ink, e.g., a textile material.

Also, in the embodiments above, heat is applied to the medium M and the transfer sheet 6. However, the medium M and the transfer sheet 6 do not necessarily need to be heated as long as there are no problems with regard to adhesion between the transfer sheet 6 and the medium M, flexibility of the transfer sheet 6, or the like.

Also, while transfer printing can be performed at room temperature, it would also be possible to control the temperature so that a fixed temperature is provided for stable transfer conditions.

Also, if there is a plurality of ultraviolet-curing ink colors, it would be possible to perform transfer printing for each color or to perform a single transfer printing operation for a plurality of colors, e.g., two, four, or six colors.

The invention claimed is:

1. An image forming method that forms an image on a medium having a curved surface, said method comprising:

a discharging step, wherein ink is discharged from ink discharging means and said ink is applied to an elastic transfer sheet held in a flat state, the elastic transfer sheet being capable of deforming against and conformal to the curved surface of the medium;

a transferring step, wherein said transfer sheet is deformed, an ink application surface of said transfer sheet on which said ink was applied in said discharging step is brought into contact with and pressed against said medium, and said ink applied to said transfer sheet is transferred to said medium; and a cleaning step subsequent to said transferring step, wherein said ink application surface is cleaned with a cleaning unit, the cleaning unit having an elastic pressing member and a cleaning sheet.

2. The image forming method according to claim 1, further comprising a fusing step subsequent to said transferring step, wherein said ink transferred to said medium is fused.

3. The image forming method according to claim 1 or claim 2, further comprising a thickening step preceding said transferring step, wherein said ink applied to said transfer sheet is thickened.

4. The image forming method according to claim 3, wherein:

in said discharging step, said ink discharging means discharges an ultraviolet-curing ink that is cured through exposure to ultraviolet rays;

in said thickening step, ultraviolet rays are emitted onto said ink application surface and said ultraviolet curing ink applied to said transfer sheet is thickened; and in said fusing step, ultraviolet rays are emitted onto said medium and said ultraviolet-curing ink transferred to said medium undergoes final curing.

5. The image forming method according to claim 4, wherein, in said thickening step, viscosity of said ultraviolet-curing ink is in a range of 30 to 300 mPa·sec at 25 deg C.

6. The image forming method according to claim 1, wherein, in said transferring step, an elastic pad member and said medium face each other and are interposed by said transfer sheet, and said pad member is moved toward said medium.

7. The image forming method according to claim 1, wherein, in said transfer step, an elastic bag-shaped member and said medium face each other and are interposed by said transfer sheet, and said bag-shaped member is inflated.

8. The image forming method according to claim 1, wherein, in said transferring step:

said medium is inserted into a container that is formed with an opening;

said opening is covered by said ink application surface; and said container is decompressed.

9. The image forming method according to claim 1, wherein the transfer sheet is brought into contact with said medium at least by moving the medium towards the transfer sheet.

10. The image forming method according to claim 1, wherein the transfer sheet has a thin profile.

11. An image forming device that forms an image on a medium having a curved surface, said image forming device comprising:

a transfer sheet unit that uses a frame to hold an elastic transfer sheet in a flat state, the elastic transfer sheet being capable of deforming against and conformal to the curved surface of the medium;

ink discharging means that discharges ink and applies said ink to said transfer sheet;

transferring means that brings into contact with and pressing against said medium, an ink application surface of said transfer sheet on which said ink has been applied by said ink discharging means; and a cleaning unit that cleans said ink application surface, wherein the cleaning unit includes an elastic Dressing member and a cleaning sheet.

12. The image forming device according to claim 11, further comprising fusing means that fuses said ink transferred to said medium.

13. The image forming device according to claim 11 or claim 12, further comprising thickening means that thickens said ink applied to said transfer sheet.

14. The image forming device according to claim 13, wherein:

said ink discharging means discharges an ultraviolet-curing ink that is cured by exposure to ultraviolet rays;

said thickening means includes a pre-curing ultraviolet-ray emitting device that emits ultraviolet rays onto said ink application surface and thickens said ultraviolet-curing ink applied to said transfer sheet; and said fusing means includes a final curing ultraviolet-ray emitting device that emits ultraviolet rays onto said medium and subjects said ultraviolet-curing ink transferred to said medium to final curing.

15. The image forming device according to claim 11, wherein said transferring means is equipped with an elastic pad member that is provided facing said medium, interposed by said transfer sheet, and that is held in a manner that allows movement toward said medium.

16. The image forming device according to claim 15, wherein said pad member is provided opposite from said ink discharging means on the other side of said transfer sheet.

17. The image forming device according to claim 15, wherein:

said transfer sheet unit is held in a reversible manner; and said pad member is provided on the same side as said ink discharging means relative to said transfer sheet.

18. The image forming device according to claim 11, wherein said transferring means is equipped with an elastic bag-shaped member facing said medium on the other side of said transfer sheet; and inflating means that inflates said bag-shaped member.

19. The image forming device according to claim 11, wherein said transferring means is equipped with a container formed with an opening that is covered by said ink application surface and into which said medium is inserted; and decompressing means that decompresses said container.

20. The image forming device according to claim 11, wherein said frame is ring-shaped.

21. The image forming device according to claim 11, wherein said frame is formed as a polygonal ring.

22. The image forming device according to claim 11, wherein the transfer sheet is brought into contact with said medium at least by moving the medium towards the transfer sheet.

23. The image forming device according to claim 11, wherein the transfer sheet has a thin profile.

* * * * *